US009080441B2

(12) United States Patent
Meurer et al.

(10) Patent No.: US 9,080,441 B2
(45) Date of Patent: Jul. 14, 2015

(54) MULTIPLE ELECTRICAL CONNECTIONS TO OPTIMIZE HEATING FOR IN SITU PYROLYSIS

(71) Applicants: William P. Meurer, Pearland, TX (US); Matthew T. Shanley, Lebanon, NJ (US); Abdel Wadood M. El-Rabaa, Plano, TX (US)

(72) Inventors: William P. Meurer, Pearland, TX (US); Matthew T. Shanley, Lebanon, NJ (US); Abdel Wadood M. El-Rabaa, Plano, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 522 days.

(21) Appl. No.: 13/662,243

(22) Filed: Oct. 26, 2012

(65) Prior Publication Data

US 2013/0112403 A1 May 9, 2013

Related U.S. Application Data

(60) Provisional application No. 61/555,940, filed on Nov. 4, 2011.

(51) Int. Cl.
*E21B 43/24* (2006.01)
*E21B 43/267* (2006.01)

(52) U.S. Cl.
CPC ..... *E21B 43/267* (2013.01); *E21B 43/2401* (2013.01)

(58) Field of Classification Search
CPC ..... E21B 36/00; E21B 36/04; E21B 43/2405; E21B 43/2401; E21B 43/24; E21B 43/26; E21B 43/162; E21B 43/17; E21B 43/267
USPC ..... 166/248, 302, 280.1, 280.2
See application file for complete search history.

(56) References Cited

U.S. PATENT DOCUMENTS 363,419 A 5/1887 Poetsch
895,612 A 8/1908 Baker
(Continued)

FOREIGN PATENT DOCUMENTS

CA 994694 8/1976
CA 1288043 8/1991
(Continued)

OTHER PUBLICATIONS

Ali, A.H.A, et al, (2003) "Watching Rocks Change—Mechanical Earth Modeling", *Oilfield Review*, pp. 22-39.
(Continued)

*Primary Examiner* — Kenneth L Thompson
(74) *Attorney, Agent, or Firm* — ExxonMobil Upstream Research—Law Department

(57) ABSTRACT

A method for heating a subsurface formation using electrical resistance heating is provided. The method includes placing a first electrically conductive proppant into a fracture within an interval of organic-rich rock. The first electrically conductive proppant has a first bulk resistivity. The method further includes placing a second electrically conductive proppant into the fracture. The second electrically conductive proppant has a second bulk resistivity that is lower than the first bulk resistivity, and is in electrical communication with the first proppant at three or more terminal locations. The method then includes passing an electric current through the second electrically conductive proppant at a selected terminal and through the first electrically conductive proppant, such that heat is generated within the fracture by electrical resistivity. The operator may monitor resistance and switch terminals for the most efficient heating. A system for electrically heating an organic-rich rock formation below an earth surface is also provided.

50 Claims, 16 Drawing Sheets

(56) References Cited

U.S. PATENT DOCUMENTS 1,342,780 A 6/1920 Vedder
1,422,204 A 7/1922 Hoover et al.
1,666,488 A 4/1928 Crawshaw
1,701,884 A 2/1929 Hogle
1,872,906 A 8/1932 Doherty
2,033,560 A 3/1936 Wells
2,033,561 A 3/1936 Wells
2,534,737 A 12/1950 Rose
2,584,605 A 2/1952 Merriam et al.
2,634,961 A 4/1953 Ljungstrom
2,732,195 A 1/1956 Ljungstrom
2,777,679 A 1/1957 Ljungstrom
2,780,450 A 2/1957 Ljungstrom
2,795,279 A 6/1957 Sarapuu
2,812,160 A 11/1957 West et al.
2,813,583 A 11/1957 Marx et al.
2,847,071 A 8/1958 De Priester
2,887,160 A 5/1959 De Priester.
2,895,555 A 7/1959 De Priester
2,923,535 A 2/1960 Ljungstrom
2,944,803 A 7/1960 Hanson
2,952,450 A 9/1960 Purre
2,974,937 A 3/1961 Kiel
3,004,601 A 10/1961 Bodine
3,013,609 A 12/1961 Brink
3,095,031 A 6/1963 Eurenius et al.
3,106,244 A 10/1963 Parker
3,109,482 A 11/1963 O'Brien
3,127,936 A 4/1964 Eurenius
3,137,347 A 6/1964 Parker
3,149,672 A 9/1964 Orkiszewski et al.
3,170,815 A 2/1965 White
3,180,411 A 4/1965 Parker
3,183,675 A 5/1965 Schroeder
3,183,971 A 5/1965 McEver et al.
3,194,315 A 7/1965 Rogers
3,205,942 A 9/1965 Sandberg
3,225,829 A 12/1965 Chown et al.
3,228,869 A 1/1966 Irish
3,241,611 A 3/1966 Dougan
3,241,615 A 3/1966 Brandt et al.
3,254,721 A 6/1966 Smith et al.
3,256,935 A 6/1966 Nabor et al.
3,263,211 A 7/1966 Heidman
3,267,680 A 8/1966 Schlumberger
3,271,962 A 9/1966 Dahms et al.
3,284,281 A 11/1966 Thomas
3,285,335 A 11/1966 Reistle, Jr.
3,288,648 A 11/1966 Jones
3,294,167 A 12/1966 Vogel
3,295,328 A 1/1967 Bishop
3,323,840 A 6/1967 Mason et al.
3,358,756 A 12/1967 Vogel
3,372,550 A 3/1968 Schroeder
3,376,403 A 4/1968 Mircea
3,382,922 A 5/1968 Needham
3,400,762 A 9/1968 Peacock et al.
3,436,919 A 4/1969 Shock et al.
3,439,744 A 4/1969 Bradley
3,455,392 A 7/1969 Parats
3,461,957 A 8/1969 West
3,468,376 A 9/1969 Slusser et al.
3,494,640 A 2/1970 Coberly et al.
3,500,913 A 3/1970 Nordgren et al.
3,501,201 A 3/1970 Closmann et al.
3,502,372 A 3/1970 Prats
3,513,914 A 5/1970 Vogel
3,515,213 A 6/1970 Prats
3,516,495 A 6/1970 Patton
3,521,709 A 7/1970 Needham
3,528,252 A 9/1970 Gail
3,528,501 A 9/1970 Parker
3,547,193 A 12/1970 Gill
3,559,737 A 2/1971 Ralstin
3,572,838 A 3/1971 Templeton
3,592,263 A 7/1971 Nelson
3,599,714 A 8/1971 Messman
3,602,310 A 8/1971 Halbert
3,613,785 A 10/1971 Closmann et al.
3,620,300 A 11/1971 Crowson
3,642,066 A * 2/1972 Gill ..... 166/248
3,661,423 A 5/1972 Garrett
3,692,111 A 9/1972 Breithaupt et al.
3,695,354 A 10/1972 Dilgren et al.
3,700,280 A 10/1972 Papadopoulos et al.
3,724,225 A 4/1973 Mancini et al.
3,729,965 A 5/1973 Gartner
3,730,270 A 5/1973 Allred
3,739,851 A 6/1973 Beard
3,741,306 A 6/1973 Papadopoulos
3,759,328 A 9/1973 Ueber et al.
3,759,329 A 9/1973 Ross
3,759,574 A 9/1973 Beard
3,779,601 A 12/1973 Beard
3,880,238 A 4/1975 Tham et al.
3,882,937 A 5/1975 Robinson
3,882,941 A 5/1975 Pelofsky
3,888,307 A 6/1975 Closmann
3,924,680 A 12/1975 Terry
3,943,722 A 3/1976 Ross
3,950,029 A 4/1976 Timmins
3,958,636 A 5/1976 Perkins
3,967,853 A 7/1976 Closmann et al.
3,978,920 A 9/1976 Badyopadhyay
3,999,607 A 12/1976 Pennington et al.
4,003,432 A 1/1977 Paull et al.
4,005,750 A 2/1977 Shuck
4,007,786 A 2/1977 Schlinger
4,008,762 A 2/1977 Fisher et al.
4,008,769 A 2/1977 Chang
4,014,575 A 3/1977 French et al.
4,030,549 A 6/1977 Bouck
4,037,655 A 7/1977 Carpenter
4,043,393 A 8/1977 Fisher et al.
4,047,760 A 9/1977 Ridley
4,057,510 A 11/1977 Crouch et al.
4,065,183 A 12/1977 Hill et al.
4,067,390 A 1/1978 Camacho et al.
4,069,868 A 1/1978 Terry
4,071,278 A 1/1978 Carpenter et al.
4,093,025 A 6/1978 Terry
4,096,034 A 6/1978 Anthony
4,125,159 A 11/1978 Vann
4,140,180 A 2/1979 Bridges et al.
4,148,359 A 4/1979 Laumbach et al.
4,149,595 A 4/1979 Cha
4,160,479 A 7/1979 Richardson et al.
4,163,475 A 8/1979 Cha et al.
4,167,291 A 9/1979 Ridley
4,169,506 A 10/1979 Berry
4,185,693 A 1/1980 Crumb et al.
4,186,801 A 2/1980 Madgavkar et al.
4,202,168 A 5/1980 Acheson et al.
4,239,283 A 12/1980 Ridley
4,241,952 A 12/1980 Ginsburgh
4,246,966 A 1/1981 Stoddard et al.
4,250,230 A 2/1981 Terry
4,265,310 A 5/1981 Britton et al.
4,271,905 A 6/1981 Redford et al.
4,272,127 A 6/1981 Hutchins
4,285,401 A 8/1981 Erickson
4,318,723 A 3/1982 Holmes et al.
4,319,635 A 3/1982 Jones
4,320,801 A 3/1982 Rowland et al.
4,324,291 A 4/1982 Wong et al.
4,340,934 A 7/1982 Segesman
4,344,485 A 8/1982 Butler
4,344,840 A 8/1982 Kunesh
4,353,418 A 10/1982 Hoekstra et al.
4,358,222 A 11/1982 Landau
4,362,213 A 12/1982 Tabor
4,368,921 A 1/1983 Hutchins
4,369,842 A 1/1983 Cha
4,372,615 A 2/1983 Ricketts

(56) References Cited

U.S. PATENT DOCUMENTS 4,375,302 A 3/1983 Kalmar
4,384,614 A 5/1983 Justheim
4,396,211 A 8/1983 McStravick et al.
4,397,502 A 8/1983 Hines
4,401,162 A 8/1983 Osborne
4,412,585 A 11/1983 Bouck
4,417,449 A 11/1983 Hegarty et al.
4,468,376 A 8/1984 Suggitt
4,472,935 A 9/1984 Acheson et al.
4,473,114 A 9/1984 Bell et al.
4,474,238 A 10/1984 Gentry et al.
4,483,398 A 11/1984 Peters et al.
4,485,869 A 12/1984 Sresty et al.
4,487,257 A 12/1984 Dauphine
4,487,260 A 12/1984 Pittman et al.
4,495,056 A 1/1985 Venardos
4,511,382 A 4/1985 Valencia et al.
4,532,991 A 8/1985 Hoekstra et al.
4,533,372 A 8/1985 Valencia et al.
4,537,067 A 8/1985 Sharp et al.
4,545,435 A 10/1985 Bridges et al.
4,546,829 A 10/1985 Martin et al.
4,550,779 A 11/1985 Zakiewicz
4,552,214 A 11/1985 Forgac et al.
4,567,945 A * 2/1986 Segalman ..... 166/248
4,585,063 A 4/1986 Venardos et al.
4,589,491 A 5/1986 Perkins
4,589,973 A 5/1986 Minden
4,602,144 A 7/1986 Vogel
4,607,488 A 8/1986 Karinthi et al.
4,626,665 A 12/1986 Fort
4,633,948 A 1/1987 Closmann
4,634,315 A 1/1987 Owen et al.
4,637,464 A 1/1987 Forgac et al.
4,640,352 A 2/1987 Vanmeurs et al.
4,671,863 A 6/1987 Tejeda
4,694,907 A 9/1987 Stahl et al.
4,704,514 A 11/1987 Van Egmond et al.
4,705,108 A 11/1987 Little et al.
4,706,751 A 11/1987 Gonduin
4,730,671 A 3/1988 Perkins
4,737,267 A 4/1988 Pao et al.
4,747,642 A 5/1988 Gash et al.
4,754,808 A 7/1988 Harmon et al.
4,776,638 A 10/1988 Hahn
4,779,680 A 10/1988 Sydansk
4,815,790 A 3/1989 Rosar et al.
4,817,711 A 4/1989 Jeambey
4,817,717 A * 4/1989 Jennings et al. ..... 166/278
4,828,031 A 5/1989 Davis
4,860,544 A 8/1989 Krieg et al.
4,886,118 A 12/1989 Van Meurs et al.
4,923,493 A 5/1990 Valencia et al.
4,926,941 A 5/1990 Glandt et al.
4,928,765 A 5/1990 Nielson
4,929,341 A 5/1990 Thirumalachar et al.
4,954,140 A 9/1990 Kawashima et al.
4,974,425 A 12/1990 Krieg et al.
5,016,709 A 5/1991 Combe et al.
5,036,917 A * 8/1991 Jennings et al. ..... 166/272.3
5,036,918 A 8/1991 Jennings et al.
5,050,386 A 9/1991 Krieg et al.
5,051,811 A 9/1991 Williams et al.
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al.
5,217,076 A 6/1993 Masek
5,236,039 A 8/1993 Edelstein
5,255,742 A 10/1993 Mikus
5,275,063 A 1/1994 Steiger et al.
5,277,062 A 1/1994 Blauch et al.
5,297,420 A 3/1994 Gillilan
5,297,626 A 3/1994 Vinegar et al.
5,305,829 A 4/1994 Kumar
5,325,918 A 7/1994 Berryman et al.
5,346,307 A 9/1994 Ramirez et al.
5,372,708 A 12/1994 Gewertz
5,377,756 A 1/1995 Northrop et al.
5,392,854 A 2/1995 Vinegar et al.
5,411,089 A 5/1995 Vinegar et al.
5,416,257 A 5/1995 Peters
5,539,853 A 7/1996 Jamaluddin et al.
5,620,049 A * 4/1997 Gipson et al. ..... 166/248
5,621,844 A 4/1997 Bridges
5,635,712 A 6/1997 Scott et al.
5,661,977 A 9/1997 Shnell
5,724,805 A 3/1998 Golomb et al.
5,730,550 A 3/1998 Andersland et al.
5,838,634 A 11/1998 Jones et al.
5,844,799 A 12/1998 Joseph et al.
5,868,202 A 2/1999 Hsu
5,899,269 A 5/1999 Wellington et al.
5,905,657 A 5/1999 Celniker
5,907,662 A * 5/1999 Buettner et al. ..... 392/301
5,938,800 A 8/1999 Verrill et al.
5,956,971 A 9/1999 Cole et al.
6,015,015 A 1/2000 Luft et al.
6,016,867 A 1/2000 Gregoli et al.
6,023,554 A 2/2000 Vinegar et al.
6,055,803 A 5/2000 Mastronarde et al.
6,056,057 A 5/2000 Vinegar et al.
6,079,499 A 6/2000 Mikus et al.
6,112,808 A 9/2000 Isted
6,148,602 A 11/2000 Demetri
6,148,911 A * 11/2000 Gipson et al. ..... 166/248
6,158,517 A 12/2000 Hsu
6,246,963 B1 6/2001 Cross et al.
6,247,358 B1 6/2001 Dos Santos
6,319,395 B1 11/2001 Kirkbride et al.
6,328,104 B1 12/2001 Graue
6,409,226 B1 6/2002 Slack et al.
6,434,435 B1 8/2002 Tubel et al.
6,480,790 B1 11/2002 Calvert et al.
6,540,018 B1 4/2003 Vinegar et al.
6,547,956 B1 4/2003 Mukherjee et al.
6,581,684 B2 6/2003 Wellington et al.
6,585,046 B2 7/2003 Neuroth et al.
6,589,303 B1 7/2003 Lokhandwale et al.
6,591,906 B2 7/2003 Wellington et al.
6,607,036 B2 * 8/2003 Ranson et al. ..... 166/302
6,609,735 B1 8/2003 DeLange et al.
6,609,761 B1 8/2003 Ramey et al.
6,659,650 B2 12/2003 Joki et al.
6,659,690 B1 12/2003 Abadi
6,668,922 B2 12/2003 Ziauddin et al.
6,684,644 B2 2/2004 Mittricker et al.
6,684,948 B1 2/2004 Savage
6,708,758 B2 3/2004 de Rouffignac et al.
6,709,573 B2 3/2004 Smith
6,712,136 B2 3/2004 de Rouffignac et al.
6,715,546 B2 4/2004 Vinegar et al.
6,722,429 B2 4/2004 de Rouffignac et al.
6,740,226 B2 5/2004 Mehra et al.
6,742,588 B2 6/2004 Wellington et al.
6,745,831 B2 6/2004 De Roufignac et al.
6,745,832 B2 6/2004 Wellington et al.
6,745,837 B2 6/2004 Wellington et al.
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al.
6,796,139 B2 9/2004 Briley et al.
6,820,689 B2 11/2004 Sarada
6,832,485 B2 12/2004 Sugarmen et al.
6,854,929 B2 2/2005 Vinegar et al.
6,858,049 B2 2/2005 Mittricker
6,877,555 B2 4/2005 Karanikas et al.
6,880,633 B2 4/2005 Wellington et al.
6,887,369 B2 5/2005 Moulton et al.
6,896,053 B2 5/2005 Berchenko et al.
6,896,707 B2 5/2005 O'Rear et al.

(56) References Cited

U.S. PATENT DOCUMENTS 6,913,078 B2 7/2005 Shahin et al.
6,915,850 B2 7/2005 Vinegar et al.
6,918,442 B2 7/2005 Wellington et al.
6,918,443 B2 7/2005 Wellington et al.
6,918,444 B2 7/2005 Passey et al.
6,923,257 B2 8/2005 Wellington et al.
6,923,258 B2 8/2005 Wellington et al.
6,929,067 B2 8/2005 Vinegar et al.
6,932,155 B2 8/2005 Vinegar et al.
6,948,562 B2 9/2005 Wellington et al.
6,951,247 B2 10/2005 De Rouffignac et al.
6,953,087 B2 10/2005 de Rouffignac et al.
6,964,300 B2 11/2005 Vinegar et al.
6,969,123 B2 11/2005 Vinegar et al.
6,988,549 B1 1/2006 Babcock
6,991,032 B2 1/2006 Berchenko et al.
6,991,033 B2 1/2006 Wellington et al.
6,994,160 B2 2/2006 Wellington et al.
6,994,169 B2 2/2006 Zhang et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,004,985 B2 2/2006 Wallace et al.
7,011,154 B2 3/2006 Maher et al.
7,013,972 B2 3/2006 Vinegar et al.
7,028,543 B2 4/2006 Hardage et al.
7,032,660 B2 4/2006 Vinegar et al.
7,036,583 B2 5/2006 de Rouffignac et al.
7,040,397 B2 5/2006 Rouffignac et al.
7,040,399 B2 5/2006 Wellington et al.
7,043,920 B2 5/2006 Viteri et al.
7,048,051 B2 5/2006 McQueen
7,051,807 B2 5/2006 Vinegar et al.
7,051,811 B2 5/2006 Rouffignac et al.
7,055,600 B2 6/2006 Messier et al.
7,063,145 B2 6/2006 Veenstra et al.
7,066,254 B2 6/2006 Vinegar et al.
7,073,578 B2 7/2006 Vinegar et al.
7,077,198 B2 7/2006 Vinegar et al.
7,077,199 B2 7/2006 Vinegar et al.
7,090,013 B2 8/2006 Wellington
7,093,655 B2 8/2006 Atkinson
7,096,942 B1 8/2006 de Rouffignac et al.
7,096,953 B2 8/2006 de Rouffignac et al.
7,100,994 B2 9/2006 Vinegar et al.
7,103,479 B2 9/2006 Patwardhan et al.
7,104,319 B2 9/2006 Vinegar et al.
7,121,342 B2 10/2006 Vinegar et al.
7,124,029 B2 10/2006 Jammes et al.
7,143,572 B2 12/2006 Ooka et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al.
7,243,618 B2 7/2007 Gurevich
7,255,727 B2 8/2007 Monereau et al.
7,322,415 B2 1/2008 de St. Remey
7,331,385 B2 2/2008 Symington et al.
7,353,872 B2 4/2008 Sandberg
7,357,180 B2 4/2008 Vinegar et al.
7,405,243 B2 7/2008 Lowe et al.
7,441,603 B2 10/2008 Kaminsky et al.
7,461,691 B2 12/2008 Vinegar et al.
7,472,748 B2 1/2009 Gdanski et al.
7,484,561 B2 2/2009 Bridges
7,516,785 B2 4/2009 Kaminsky
7,516,786 B2 4/2009 Dallas et al.
7,516,787 B2 4/2009 Kaminsky
7,546,873 B2 6/2009 Kim et al.
7,549,470 B2 6/2009 Vinegar et al.
7,556,095 B2 7/2009 Vinegar
7,591,879 B2 9/2009 Sundaram et al.
7,604,054 B2 10/2009 Hocking
7,617,869 B2 11/2009 Carney et al.
7,631,691 B2 * 12/2009 Symington et al. ..... 166/248
7,637,984 B2 12/2009 Adamopoulos
7,644,993 B2 1/2010 Kaminsky et al.
7,647,971 B2 1/2010 Kaminsky
7,647,972 B2 1/2010 Kaminsky
7,654,320 B2 2/2010 Payton
7,669,657 B2 3/2010 Symington et al.
7,743,826 B2 6/2010 Harris et al.
7,798,221 B2 9/2010 Vinegar et al.
7,832,483 B2 11/2010 Trent
7,857,056 B2 12/2010 Kaminsky et al.
7,860,377 B2 12/2010 Vinegar et al.
7,905,288 B2 3/2011 Kinkead
8,087,460 B2 1/2012 Kaminsky
8,127,865 B2 3/2012 Watson et al.
8,176,982 B2 5/2012 Gil et al.
8,356,935 B2 1/2013 Arora et al.
8,596,355 B2 12/2013 Kaminsky et al.
8,608,249 B2 12/2013 Vinegar et al.
8,616,280 B2 12/2013 Kaminsky et al.
8,622,127 B2 1/2014 Kaminsky
8,622,133 B2 * 1/2014 Kaminsky ..... 166/302
2001/0049342 A1 12/2001 Passey et al.
2002/0013687 A1 1/2002 Ortoleva
2002/0023751 A1 2/2002 Neuroth et al.
2002/0029882 A1 3/2002 Rouffignac et al.
2002/0049360 A1 4/2002 Wellington et al.
2002/0077515 A1 6/2002 Wellington et al.
2002/0099504 A1 7/2002 Cross et al.
2003/0070808 A1 4/2003 Allison
2003/0080604 A1 5/2003 Vinegar et al.
2003/0085570 A1 5/2003 Ernst et al.
2003/0111223 A1 6/2003 Rouffignac et al.
2003/0131994 A1 7/2003 Vinegar et al.
2003/0131995 A1 7/2003 de Rouffignac et al.
2003/0178195 A1 9/2003 Agee et al.
2003/0183390 A1 10/2003 Veenstra et al.
2003/0192691 A1 10/2003 Vinegar et al.
2003/0196788 A1 10/2003 Vinegar et al.
2003/0196789 A1 10/2003 Wellington et al.
2003/0209348 A1 11/2003 Ward et al.
2003/0213594 A1 11/2003 Wellington et al.
2004/0020642 A1 2/2004 Vinegar et al.
2004/0040715 A1 3/2004 Wellington et al.
2004/0140095 A1 7/2004 Vinegar et al.
2004/0198611 A1 10/2004 Atkinson
2004/0200618 A1 10/2004 Piekenbrock
2004/0211557 A1 10/2004 Cole et al.
2005/0051327 A1 3/2005 Vinegar et al.
2005/0194132 A1 9/2005 Dudley et al.
2005/0211434 A1 9/2005 Gates et al.
2005/0211569 A1 9/2005 Botte et al.
2005/0229491 A1 10/2005 Loffler
2005/0252656 A1 11/2005 Maguire
2005/0252832 A1 11/2005 Doyle et al.
2005/0252833 A1 11/2005 Doyle et al.
2005/0269077 A1 12/2005 Sandberg
2005/0269088 A1 12/2005 Vinegar et al.
2006/0021752 A1 2/2006 de St. Remey
2006/0100837 A1 5/2006 Symington et al.
2006/0102345 A1 5/2006 McCarthy et al.
2006/0106119 A1 5/2006 Guo et al.
2006/0199987 A1 9/2006 Kuechler et al.
2006/0213657 A1 9/2006 Berchenko et al.
2007/0000662 A1 1/2007 Symington et al.
2007/0023186 A1 2/2007 Kaminsky et al.
2007/0045265 A1 3/2007 McKinzie, II
2007/0045267 A1 3/2007 Vinegar et al.
2007/0084418 A1 4/2007 Gurevich
2007/0095537 A1 5/2007 Vinegar
2007/0102359 A1 5/2007 Lombardi et al.
2007/0131415 A1 6/2007 Vinegar et al.
2007/0137869 A1 6/2007 MacDougall et al.
2007/0144732 A1 6/2007 Kim et al.
2007/0209799 A1 9/2007 Vinegar et al.
2007/0246994 A1 10/2007 Kaminsky et al.
2008/0087420 A1 4/2008 Kaminsky et al.
2008/0087421 A1 4/2008 Kaminsky

(56) References Cited

U.S. PATENT DOCUMENTS

| | | | | |
|---|---|---|---|---|
| 2008/0087422 | A1 | 4/2008 | Kobler et al. | |
| 2008/0087426 | A1 | 4/2008 | Kaminsky | |
| 2008/0087427 | A1 | 4/2008 | Kaminsky et al. | |
| 2008/0087428 | A1 | 4/2008 | Symington et al. | |
| 2008/0127632 | A1 | 6/2008 | Finkenrath | |
| 2008/0173443 | A1 | 7/2008 | Symington et al. | |
| 2008/0185145 | A1 | 8/2008 | Carney et al. | |
| 2008/0207970 | A1 | 8/2008 | Meurer et al. | |
| 2008/0230219 | A1 | 9/2008 | Kaminsky | |
| 2008/0271885 | A1 | 11/2008 | Kaminsky | |
| 2008/0283241 | A1 | 11/2008 | Kaminsky et al. | |
| 2008/0289819 | A1 | 11/2008 | Kaminsky et al. | |
| 2008/0290719 | A1 | 11/2008 | Kaminsky et al. | |
| 2008/0314593 | A1 | 12/2008 | Vinegar et al. | |
| 2009/0032251 | A1 | 2/2009 | Cavender et al. | |
| 2009/0038795 | A1 | 2/2009 | Kaminsky et al. | |
| 2009/0050319 | A1 | 2/2009 | Kaminsky et al. | |
| 2009/0101346 | A1 | 4/2009 | Vinegar et al. | |
| 2009/0101348 | A1 | 4/2009 | Kaminsky | |
| 2009/0107679 | A1 | 4/2009 | Kaminsky | |
| 2009/0133935 | A1 | 5/2009 | Kinkead | |
| 2009/0145598 | A1 | 6/2009 | Symington et al. | |
| 2009/0200290 | A1 | 8/2009 | Cardinal et al. | |
| 2009/0211754 | A1 | 8/2009 | Verret et al. | |
| 2009/0308608 | A1 | 12/2009 | Kaminsky et al. | |
| 2010/0038083 | A1 | 2/2010 | Bicerano | |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Symington et al. | |
| 2010/0101793 | A1* | 4/2010 | Symington et al. | 166/302 |
| 2010/0133143 | A1 | 6/2010 | Roes et al. | |
| 2010/0218946 | A1 | 9/2010 | Symington et al. | |
| 2010/0276983 | A1 | 11/2010 | Dunn et al. | |
| 2010/0282460 | A1 | 11/2010 | Stone et al. | |
| 2010/0307744 | A1 | 12/2010 | Cochet et al. | |
| 2010/0314108 | A1 | 12/2010 | Crews et al. | |
| 2010/0319909 | A1 | 12/2010 | Symington et al. | |
| 2011/0000221 | A1 | 1/2011 | Minta et al. | |
| 2011/0000671 | A1 | 1/2011 | Hershkowitz | |
| 2011/0146982 | A1 | 6/2011 | Kaminsky et al. | |
| 2011/0257944 | A1 | 10/2011 | Du et al. | |
| 2011/0290490 | A1 | 12/2011 | Kaminsky et al. | |
| 2011/0309834 | A1 | 12/2011 | Homan et al. | |
| 2012/0012302 | A1 | 1/2012 | Vogel et al. | |
| 2012/0267110 | A1 | 10/2012 | Meurer et al. | |
| 2012/0325458 | A1 | 12/2012 | El-Rabaa et al. | |
| 2013/0043029 | A1 | 2/2013 | Vinegar et al. | |
| 2013/0106117 | A1 | 5/2013 | Sites | |
| 2013/0112403 | A1 | 5/2013 | Meurer et al. | |
| 2013/0292114 | A1 | 11/2013 | Lin et al. | |
| 2013/0292177 | A1 | 11/2013 | Meurer et al. | |
| 2013/0319662 | A1 | 11/2013 | Alvarez et al. | |

FOREIGN PATENT DOCUMENTS

| | | |
|---|---|---|
| CA | 2377467 | 1/2001 |
| CA | 2560223 | 3/2007 |
| EP | 0387846 | 9/1990 |
| EP | 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| GB | 2430454 | 3/2007 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 03/035811 | 5/2003 |
| WO | WO 2005/010320 | 2/2005 |
| WO | WO 2005/045192 | 5/2005 |
| WO | WO 2005/091883 | 10/2005 |
| WO | WO 2006/115943 | 11/2006 |
| WO | WO2007/033371 | 3/2007 |
| WO | WO2007/050445 | 5/2007 |
| WO | WO 2007/050479 | 5/2007 |
| WO | WO 2010/011402 | 1/2010 |
| WO | WO2010/047859 | 4/2010 |
| WO | WO2011/116148 | 9/2011 |
| WO | WO 2011/153339 | 12/2011 |

OTHER PUBLICATIONS

Allred, (1964) "Some Characteristic Properties of Colorado Oil Shale Which May Influence in Situ Processing," *Quarterly Colo. School of Mines, 1st Symposium Oil Shale*, v.59. No. 3, pp. 47-75.

Asquith, G., et al., (2004) *Basic Well Log Analysis*, Second Ed., Chapter 1, pp. 1-20.

Ball, J.S., et al. (1949) "Composition of Colorado Shale-Oil Naphtha", *Industrial and Engineering Chemistry*, vol. 41, No. 3 pp. 581-587.

Barnes, A. L. et al. (1968) "Quarterly of the Colorado School of Mines" *Fifth Symposium on Oil Shale*, v. 63(4), Oct. 1968, pp. 827-852.

Bastow, T.P., (1998) Sedimentary Processes Involving Aromatic Hydrocarbons >>. Thesis (PhD in Applied Chemistry) Curtin University of Technology (Australia), December, p. 102.

Baugman, G. L. (1978) *Synthetic Fuels Data Handbook*, Second Edition, Cameron Engineers Inc.

Berry, K. L., et al. (1982) "Modified in situ retorting results of two field retorts", Gary, J. H., ed., 15th Oil Shale Symp., CSM, pp. 385-396.

Blanton, T. L. et al, (1999) "Stress Magnitudes from Logs: Effects of Tectonic Strains and Temperature", *SPE Reservoir Eval. & Eng.* 2, vol. 1, February, pp. 62-68.

Boyer, H. E. et al. (1985) "Chapter 16: Heat-Resistant Materials," *Metals Handbook*, American Society for Metals, 16 pages.

Brandt, A. R., "*Converting Oil Shale to Liquid Fuels: Energy Inputs and Greenhouse Gas Emissions of the Shell in Situ Conversion Process*," Environ. Sci. Technol. 2008, 42, pp. 7489-7495.

Brandt, H. et al. (1965) "Stimulating Heavy Oil Reservoirs With Downhole Air-Gas Burners," *World Oil*, (Sep. 1965), pp. 91-95.

Bridges, J. E., et al. (1983) "The IITRI in situ fuel recovery process", *J. Microwave Power*, v. 18, pp. 3-14.

Burnham, A. K. et al. (1983) "High-Pressure Pyrolysis of Green River Oil Shale" in Geochemistry and Chemistry of Oil Shales: ACS Symposium Series.

Burwell, E. L. et al. (1970) "Shale Oil Recovery by In-Situ Retorting—A Pilot Study" Journal of Petroleum Engr., Dec. 1970, pp. 1520-1524.

Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.

Chute, F. S., and Vermeulen, F. E., (1988) "Present and potential applications of electromagnetic heating in the in situ recovery of oil", AOSTRA J. Res., v. 4, pp. 19-33.

Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.

Cipolla, C.L., et al. (1994), "Practical Application of in-situ Stress Profiles", *Society of Petroleum Engineers*, SPE 28607, pp. 487-499.

Cook, G. L. et al. (1968) "The Composition of Green River Shale Oils" United Nations Symposium of the Development and Utilization of Oil Shale Resources, 23 pgs.

Covell, J. R., et al. (1984) "Indirect in situ retorting of oil shale using the TREE process", Gary, J. H., ed., 17th Oil Shale Symposium Proceedings, Colorado School of Mines, pp. 46-58.

Cummins, J. J. et al. (1972) "Thermal Degradation of Green River Kerogen at 150 to 350C: Rate of Product Formation, Report of Investigation 7620," *US Bureau of Mines*, 1972.

(56) References Cited

OTHER PUBLICATIONS

Day, R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jml. Petro. Tech.*, (Dec. 1963), pp. 1297-1302.
Domine, F. et al. (2002) "Up to What Temperature is Petroleum Stable? New Insights from a 5200 Free Radical Reactions Model", *Organic Chemistry*, 33, pp. 1487-1499.
Dougan, P. M. et al. (1981) "BX in Situ Oil Shale Project," *Colorado School of Mines; Fourteenth Oil Shale Symposium Proceedings*, 1981, pp. 118-127.
Dougan, P. M. (1979) "The BX in Situ Oil Shale Project," *Chem. Engr. Progress*, pp. 81-84.
Duncan, D. C., (1967) "Geologic Setting of Oil Shale Deposits and World Prospects," *in Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, Abstract, 1 page.
Farouq Ali, S. M., (1994), "Redeeming features of in situ combustion", DOE/NIPER *Symposium on in Situ Combustion Practices—Past, Present, and Future Application*, Tulsa, OK, Apr. 21-22, No. ISC 1, p. 3-8.
Fisher, S. T. (1980) "A Comparison of Eleven Processes for Production of Energy from the Solid Fossil Fuels of North America," *SPE* 9098, pp. 1-27.
Fox, J. P, (1980) "Water-related Impacts of In-Situ Oil Shale Processing," *California Univ., Berkeley, Lawrence Berkeley Lab*, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (August) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, August pp. 134-143.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Henderson, W, et al. (1968) "Thermal Alteration as a Contributory Process to the Genesis of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion*, 14(2), June pp. 92-101.
Hill, G.R. et al. (1967) "The Characteristics of a Low Temperature in Situ Shale Oil," *4th Symposium on Oil Shale, Quarterly of the Colorado School of Mines*, v.62(3), pp. 641-656.
Hill, G. R. et al. (1967) "Direct Production of a Low Pour Point High Gravity Shale Oil", *I&EC Product Research and Development*, 6(1), March pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.
Holmes, A. S. et al. (1983) "Pilot Tests Prove Out Cryogenic Acid-Gas/Hydrocarbon Separation Processes," *Oil & Gas Journal*, pp. 85-91.
Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.
Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," *University of Utah*, May 1966.
Katz, D.L. et al. (1978) "*Predicting Phase Behavior of Condensate/Crude-Oil Systems Using Methane Interaction Coefficients, J. Petroleum Technology*", pp. 1649-1655.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium* (*NARMS*): *Rock Mechanics Across Borders and Disciplines*, Houston, Texas, Jun. 5-9, ARMA/NARMS 04-627.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.

(56) References Cited

OTHER PUBLICATIONS

Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-7.
Moschovidis, Z. (1989) "Interwell Communication by Concurrent Fracturing—a New Stimulation Technique", *Journ. of Canadian Petro. Tech.* 28(5), pp. 42-48.
Motzfeldt, K. (1954) "The Thermal Decomposition of Sodium Carbonate by the Effusion Method," *Jml. Phys. Chem.*, v. LIX, pp. 139-147.
Mut, Stephen (2005) "The Potential of Oil Shale," *Shell Oil Presentation at National Academies, Trends in Oil Supply Demand*, in Washington, DC, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Newkirk, A. E. et al. (1958) "Drying and Decomposition of Sodium Carbonate," *Anal. Chem.*, 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Plischke, B., (1994) "Finite Element Analysis of Compaction and Subsidence—Experience Gained from Several Chalk Fields", *Society of Petroleum Engineers*, SPE 28129, 1994, pp. 795-802.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol.*, pp. 1078-1088.
Rajeshwar, K. et al. (1979) "Review: Thermophysical Properties of Oil Shales", *Journal of Materials Science*, v.14, pp. 2025-2052.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; 2006 About.com Electrical resistivity of materials. [Retrieved on Oct. 15, 2009] Retrieved from internet: URL: http://www.reade.com/Particle%5FBriefings/elec%5Fres.html. Entire Document.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Ruzicka, D.J. et al. (1987) "Modified Method Measures Bromine Number of Heavy Fuel Oils", *Oil & Gas Journal*, 85(31), Aug. 3, pp. 48-50.
Salamonsson, G. (1951) "The Ljungstrom in Situ Method for Shale-Oil Recovery," *2nd Oil Shale and Cannel Coal Conference*, 2, Glasgow, Scotland, Inst. of Petrol., London, pp. 260-280.
Sahu, D. et al. (1988) "Effect of Benzene and Thiophene on Rate of Coke Formation During Naphtha Pyrolysis", *Canadian Joum. of Chem. Eng.*, 66, Oct. pp. 808-816.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, ARMA/NARMS 04-470.
Smith, F. M. (1966) "A Down-hole Burner—Versatile Tool for Well Heating," *25th Tech. Conf. on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stevens, A. L., and Zahradnik, R. L. (1983) "Results from the simultaneous processing of modified in situ retorts 7& 8", Gary, J. H., ed., *16th Oil Shale Symp.*, CSM, p. 267-280.
Stoss, K. et al. (1979) "Uses and Limitations of Ground Freezing With Liquid Nitrogen," *Engineering Geology*, 13, pp. 485-494.
Symington, W.A., et al (2006) ExxonMobil's electrofrac process for in situ oil shale conversion 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Templeton, C. C. (1978) "Pressure-Temperature Relationship for Decomposition of Sodium Bicarbonate from 200 to 600° F.," *J. of Chem. And Eng. Data*, 23(1), pp. 7-8.
Thomas, A. M. (1963) "Thermal Decomposition of Sodium Carbonate Solutions," *J. of Chem. And Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations 7576*, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-174, 175-198 and 254-266.
Tissot, B. P., and Welte, D. H. (1984) *Petroleum Formation and Occurrence*, New York, Springer-Verlag, p. 267-289 and 470-492.

(56) References Cited

OTHER PUBLICATIONS

Turta, A., (1994), "In situ combustion—from pilot to commercial application", *DOE/NIPER Symposium on In Situ Combustion Practices—Past, Present, and Future Application*, Tulsa, OK, Apr. 21-22, No. ISC 3, p. 15-39.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: Reprint Series No. 28", *Soc. of Petroleum Engineers* SPE 14085, Part I, Overview.
Warpinski, N. R., (1989) "Elastic and Viscoelastic Calculations of Stresses in Sedimentary Basins", *SPE Formation Evaluation*, vol. 4, pp. 522-530.
Yen, T. F. et al. (1976) *Oil Shale*, Amsterdam, Elsevier, p. 216-267.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.
Oil & Gas Journal, 1998, "Aussie oil shale project moves to Stage 2", Oct. 26, p. 42.
"Encyclopedia of Chemical Technology" (4th ed.), *Alkali and Chlorine Products*, pp. 1025-1039 (1998).
EP Search Report dated Dec. 29, 2003 (RS 110243, Corresponding to US Pat 7,331,385).
EP Search Report dated Mar. 17, 2004 (RS 110686, Corresponding to U.S. Patent 7,441,603).
EP Search Report, Supplementary dated Apr. 10, 2007 (EP 04 77 9878 Corresponding to U.S. Patent 7,441,603).
EP Search Report dated Apr. 29, 2005 (RS 112183, Corresponding to U.S. Appl. No. 11/250,804, Published as US 2006/0100837 on May 11, 2008).
EP Search Report dated Jun. 2, 2006 (RS113865, corresponding to U.S. Appl. No. 11/726,651).
EP Search Report dated Feb. 16, 2007 (RS 114808, Corresponding to U.S. Appl. No. 11/973,746, Published as US 2008/0087420 on May 17, 2008).
EP Search Report dated Feb. 16, 2007 (RS 114804, Corresponding to U.S. Appl. No. 11/973,750, Published as US 2008/0087427 on Apr. 17, 2008).
EP Search Report dated Mar. 21, 2007 (RS 114890, Corresponding to U.S. Patent 7,516,787).
EP Search Report dated Feb. 16, 2007 (RS 114807, Corresponding to U.S. Patent 7,669,657).
EP Search Report dated Nov. 13, 2007 (RS 115479, Corresponding to U.S. Appl. No. 12/148,414).
EP Search Report dated Aug. 29, 2007 (No. RS115553, Corresponding to U.S. Appl. No. 12/148,388).
EP Search Report dated Jul. 4, 2007 ( RS 115341 Corresponding to U.S. Appl. No. 12/074,899).
EP Search Report dated Jul. 5, 2007 (RS 115432 Corresponding to U.S. Appl. No. 12/075,087).
EP Search Report dated Mar. 12, 2009 (EP 08 00 3956,—Corresponding to U.S. Appl. No. 12/271,521).
EP Search Report dated Aug. 29, 2007 (RS 1155554, Corresponding to U.S. Appl. No. 12/154,238).
EP Search Report dated Aug. 28, 2007 (RS 1155555, Corresponding to U.S. Appl. No. 12/154,256).
International Search Report for PCT/US01/09247 Jun. 20, 2001.
International Search Report for PCT/US04/11508, Jan. 5, 2005.
International Search Report for PCT/US08/88045, Feb. 12, 2009.
International Search Report for PCT/US04/24947 Mar. 10, 2005.
International Search Report for PCT/US07/07133, Jan. 4, 2008.
International Search Report for PCT/US07/21673 Jun. 24, 2008.
International Search Report for PCT/US07/21668 Apr. 29, 2008.
International Search Report for PCT/US07/21666 Apr. 4, 2008.
International Search Report for PCT/US07/21669, Apr. 29, 2008.
International Search Report for PCT/US07/21660 Apr. 4, 2008.
International Search Report for PCT/US07/021968, May 14, 2008.
International Search Report for PCT/US07/021968, May 21, 2008.
International Search Report for PCT/US08/005008, Aug. 29, 2008.
International Search Report for PCT/US08/05056, Aug. 25, 2008.
International Search Report for PCT/US/08/003069, Jun. 25, 2008.
International Search Report for PCT/US08/003043, Jul. 2, 2008.
International Search Report for PCT/US08/083815, Mar. 20, 2009.
International Search Report for PCT/US08/006462 Sep. 22, 2008.
International Search Report for PCT/US08/006463 Aug. 22, 2008.
International Search Report for PCT/US07/21645 Apr. 21, 2008.
International Search Report for PCT/US09/037419 Jul. 7, 2009.
International Search Report for PCT/US09/055403, Oct. 22, 2009.
International Search Report for PCT/US10/20342 Feb. 26, 2010.
International Search Report for PCT/US10/031910 Aug. 3, 2010.
International Search Report for PCT/US10/057204 Jan. 27, 2011.
International Search Report for PCT/US11/040939 Nov. 10, 2011.
International Search Report for PCT/US11/040942 Nov. 2, 2011.
International Search Report for PCT/US12/062278 Jan. 15, 2013.
International Search Report for PCT/US12/059380 Jan. 11, 2013.
U.S. Appl. No. 12/630,636 Office Action mailed Oct. 27, 2010.
U.S. Appl. No. 11/250,804 Office Action mailed Oct. 16, 2008.
U.S. Appl. No. 11/250,804 Office Action mailed Jun. 11, 2009.
U.S. Appl. No. 11/973,746 Office Action mailed Jun. 25, 2009.
U.S. Appl. No. 11/973,746 Office Action mailed Nov. 8, 2010.
U.S. Appl. No. 12/965,502 Office Action mailed Jan. 10, 2013.
U.S. Appl. No. 11/973,750 Office Action mailed Dec. 4, 2008.
U.S. Appl. No. 11/973,750 Office Action mailed Jul. 22, 2009.
U.S. Appl. No. 12/638,630 Office Action mailed Mar. 16, 2011.
U.S. Appl. No. 12/712,904 Office Action mailed Nov. 10, 2010.
U.S. Appl. No. 12/443,680 Office Action mailed Jun. 23, 2011.
U.S. Appl. No. 12/443,680 Office Action mailed Nov. 23, 2011.
U.S. Appl. No. 12/148,414 Office Action mailed May 19, 2010.
U.S. Appl. No. 12/148,414 Office Action mailed Oct. 22, 2010.
U.S. Appl. No. 12/148,388 Office Action mailed Jun. 10, 2010.
U.S. Appl. No. 12/148,388 Office Action mailed Nov. 19, 2010.
U.S. Appl. No. 12/074,899 Office Action mailed Dec. 16, 2009.
U.S. Appl. No. 12/074,899 Office Action mailed Jul. 26, 2010.
U.S. Appl. No. 12/074,899 Office Action mailed Jan. 4, 2011.
U.S. Appl. No. 12/075,087 Office Action mailed Oct. 12, 2010.
U.S. Appl. No. 12/075,087 Office Action mailed Jan. 13, 2012.
U.S. Appl. No. 12/075,087 Office Action mailed Apr. 26, 2012.
U.S. Appl. No. 12/075,087 Office Action mailed Aug. 10, 2012.
U.S. Appl. No. 12/075,087 Office Action mailed Mar. 7, 2011.
U.S. Appl. No. 12/271,521 Office Action mailed Nov. 2, 2010.
U.S. Appl. No. 11/973,898 Office Action mailed May 6, 2010.
U.S. Appl. No. 11/973,898 Office Action mailed Dec. 20, 2010.
U.S. Appl. No. 12/405,901 Office Action mailed Feb. 14, 2011.
U.S. Appl. No. 12/154,238 Office Action mailed Apr. 22, 2011.
U.S. Appl. No. 13/204,934 Office Action mailed Apr. 3, 2012.
U.S. Appl. No. 13/204,934 Office Action mailed Jul. 17, 2012.
U.S. Appl. No. 12/154,256 Office Action mailed May 9, 2011.
U.S. Appl. No. 13/072,335 Office Action mailed Sep. 5, 2012.
U.S. Appl. No. 13/072,335 Office Action mailed Oct. 16, 2012.
U.S. Appl. No. 13/072,335 Office Action mailed Feb. 5, 2013.
U.S. Appl. No. 12/148,414 Office Action mailed May 17, 2011.
U.S. Appl. No. 12/550,076 Office Action mailed Aug. 23, 2011.
U.S. Appl. No. 12/683,843 Office Action mailed Apr. 3, 2012.
U.S. Appl. No. 12/683,843 Office Action mailed Sep. 14, 2012.
U.S. Appl. No. 12/946,532 Office Action mailed Jan. 15, 2013.
U.S. Pat No. 6,918,444—Office Action mailed Sep. 16, 2004.
US Pat No. 7,331,385—Office Action mailed Jul. 12, 2007.
U.S. Pat No. 7,631,691—Office Action mailed Mar. 18, 2009.
U.S. Pat No. 7,441,603—Office Action mailed Feb. 25, 2008.
U.S. Pat No. 7,857,056—Office Action mailed Mar. 19, 2010.
US Pat No. 7,516,785—Office Action mailed Apr. 2, 2008.
US Pat No. 7,516,787—Office Action mailed Apr. 3, 2008.
U.S. Pat No. 7,647,972—Office Action mailed May 19, 2009.
U.S. Pat No. 7,647,971—Office Action mailed May 21, 2009.
U.S. Pat No. 7,669,657—Office Action mailed Jun. 26, 2008.
U.S. Pat No. 7,669,657—Office Action mailed Dec. 15, 2008.
U.S. Pat No. 7,669,657—Office Action mailed Sep. 15, 2009.
US Pat No. 7,644,993—Office Action mailed Jun. 24, 2009.

(56) References Cited

OTHER PUBLICATIONS

Anderson, R., et al (2003) "Power Generation with 100% Carbon Capture Sequestration" 2nd Annual Conference on Carbon Sequestration, Alexandria, VA.
Bridges, J.E., (2007) "Wind Power Energy Storage for In Situ Shale Oil Recovery With Minimal CO2 Emissions", IEEE Transactions on Energy Conversion, vol. 22, No. 1 Mar. 2007, pp. 103-109.
Fox, J. P., et al. (1979) "Partitioning of major, minor, and trace elements during simulated in situ oil shale retorting in a controlled-state retort", Twelfth Oil Shale Symposium Proceedings, Colorado School of Mines, Golden Colorado, Apr. 18-20, 1979.
Garland, T. R., et al. (1979) "Influence of irrigation and weathering reactions on the composition of percolates from retorted oil shale in field lysimeters", Twelfth Oil Shale Symposium Proceedings, Colorado School of Mines, Golden Colorado, Apr. 18-20, 1979, pp. 52-57.
Kilkelly, M. K., et al. (1981), "Field Studies on Paraho Retorted Oil Shale Lysimeters: Leachate, Vegetation, Moisture, Salinity and Runoff, 1977-1980", prepared for Industrial Environmental Research Laboratory, U. S. Environmental Protection Agency, Cincinnati, OH.
Nordin, J. S, et al. (1988), "Groundwater studies at Rio Blanco Oil Shale Company's retort 1 at Tract C-a", DOE/MC/11076-2458.
Poulson, R. E., et al. (1985), "Organic Solute Profile of Water from Rio Blanco Retort 1", DOE/FE/60177-2366.
Rio Blanco Oil Shale Company, (1986), "MIS Retort Abandonment Program" Jun. 1986 Pumpdown Operation.
Robson, S. G. et al., (1981), "Hydrogeochemistry and simulated solute transport, Piceance Basin, northwestern Colorado", U. S. G. S. Prof. Paper 1196.
Stanford University, (2008) "Transformation of Resources to Reserves: Next Generation Heavy-Oil Recovery Techniques", Prepared for U.S. Department of Energy, National Energy Technology Laboratory, DOE Award No. DE-FC26-04NT15526, Mar. 28, 2008.
Taylor, O. J., (1987), "Oil Shale, Water Resources and Valuable Minerals of the Piceance Basin, Colorado: The Challenge and Choices of Development". U. S. Geol. Survey Prof. Paper 1310, pp. 63-76.

* cited by examiner

MULTIPLE ELECTRICAL CONNECTIONS TO OPTIMIZE HEATING FOR IN SITU PYROLYSIS

CROSS-REFERENCE TO RELATED APPLICATION

This application claims the priority benefit of U.S. Provisional Patent Application 61/555,940 filed Nov. 4, 2011 entitled MULTIPLE ELECTRICAL CONNECTIONS TO OPTIMIZE HEATING FOR IN SITU PYROLYSIS, the entirety of which is incorporated by reference herein.

BACKGROUND OF THE INVENTION

1. Field of the Invention

The present invention relates to the field of hydrocarbon recovery from subsurface formations. More specifically, the present invention relates to the in situ recovery of hydrocarbon fluids from organic-rich rock formations including, for example, oil shale formations, coal formations and tar sands formations. The present invention also relates to methods for heating a subsurface formation using electrical energy.

2. General Discussion of Technology

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Certain geological formations are known to contain an organic matter known as "kerogen." Kerogen is a solid, carbonaceous material. When a substantial amount of kerogen is imbedded in rock formations, the mixture is referred to as oil shale. This is true whether or not the rock is, in fact, technically shale, that is, a rock formed from compacted clay.

Kerogen is subject to decomposing upon exposure to heat over a period of time. Upon heating, kerogen molecularly decomposes to produce oil, gas, and carbonaceous coke. Small amounts of water may also be generated. The oil, gas and water fluids become mobile within the rock matrix, while the carbonaceous coke remains essentially immobile.

Oil shale formations are found in various areas worldwide, including the United States. Such formations are notably found in Wyoming, Colo., and Utah. Oil shale formations tend to reside at relatively shallow depths and are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature dependent. Temperatures generally in excess of 270° C. (518° F.) over the course of many months may be required for substantial conversion. At higher temperatures substantial conversion may occur within shorter times. When kerogen is heated to the necessary temperature, chemical reactions break the larger molecules forming the solid kerogen into smaller molecules of oil and gas. The thermal conversion process is referred to as pyrolysis, or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well. Such countries include Australia, Brazil, China, Estonia, France, Russia, South Africa, Spain, Jordan and Sweden. However, the practice has been mostly discontinued in recent years because it proved to be uneconomical or because of environmental constraints on spent shale disposal. (See T. F. Yen, and G. V. Chilingarian, "*Oil Shale*," Amsterdam, Elsevier, p. 292.) Further, surface retorting requires mining of the oil shale, which limits that particular application to very shallow formations.

In the United States, the existence of oil shale deposits in northwestern Colorado has been known since the early 1900's. While research projects have been conducted in this area from time to time, no serious commercial development has been undertaken. Most research on oil shale production was carried out in the latter half of the 1900's. The majority of this research was on geology, geochemistry, and retorting in surface facilities.

In 1947, U.S. Pat. No. 2,732,195 issued to Fredrik Ljungstrom. That patent, entitled "Method of Treating Oil Shale and Recovery of Oil and Other Mineral Products Therefrom," proposed the application of heat at high temperatures to the oil shale formation in situ. The purpose of such in situ heating was to distill hydrocarbons and produce them to the surface. The '195 Ljungstrom patent is incorporated herein in its entirety by reference.

Ljungstrom coined the phrase "heat supply channels" to describe bore holes drilled into the formation. The bore holes received an electrical heat conductor which transferred heat to the surrounding oil shale. Thus, the heat supply channels served as early heat injection wells. The electrical heating elements in the heat injection wells were placed within sand or cement or other heat-conductive material to permit the heat injection wells to transmit heat into the surrounding oil shale while substantially preventing the inflow of fluids. According to Ljungstrom, the subsurface "aggregate" was heated to between 500° C. and 1,000° C. in some applications.

Along with the heat injection wells, fluid producing wells were completed in near proximity to the heat injection wells. As kerogen was pyrolyzed upon heat conduction into the aggregate or rock matrix, the resulting oil and gas would be recovered through the adjacent production wells.

Ljungstrom applied his approach of thermal conduction from heated wellbores through the Swedish Shale Oil Company. A full-scale plant was developed that operated from 1944 into the 1950's. (See G. Salamonsson, "The Ljungstrom In Situ Method for Shale-Oil Recovery," $2^{nd}$ Oil Shale and Cannel Coal Conference, v. 2, Glasgow, Scotland, Institute of Petroleum, London, p. 260-280 (1951).

Additional in situ methods have been proposed. These methods generally involve the injection of heat and/or solvent into a subsurface oil shale formation. Heat may be in the form of heated methane (see U.S. Pat. No. 3,241,611 to J. L. Dougan), flue gas, or superheated steam (see U.S. Pat. No. 3,400,762 to D. W. Peacock). Heat may also be in the form of electric resistive heating, dielectric heating, radio frequency (RF) heating (U.S. Pat. No. 4,140,180, assigned to the ITT Research Institute in Chicago, Ill.) or oxidant injection to support in situ combustion. In some instances, artificial permeability has been created in the matrix to aid the movement of pyrolyzed fluids upon heating. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W. Hoover, et al.), heat fracturing (see U.S. Pat. No. 3,284,281 to R. W. Thomas), and steam fracturing (see U.S. Pat. No. 2,952,450 to H. Purre).

It has also been disclosed to run alternating current or radio frequency electrical energy between stacked conductive fractures or electrodes in the same well in order to heat a subterranean formation. Examples of early patents discussing the use of electrical current for heating include:

- U.S. Pat. No. 3,149,672 titled "Method and Apparatus for Electrical Heating of Oil-Bearing Formations;"
- U.S. Pat. No. 3,620,300 titled "Method and Apparatus for Electrically Heating a Subsurface Formation;"
- U.S. Pat. No. 4,401,162 titled "In Situ Oil Shale Process;" and
- U.S. Pat. No. 4,705,108 titled "Method for In Situ Heating of Hydrocarbonaceous Formations."

U.S. Pat. No. 3,642,066 titled "Electrical Method and Apparatus for the Recovery of Oil," provides a description of resistive heating within a subterranean formation by running alternating current between different wells. Others have described methods to create an effective electrode in a wellbore. See U.S. Pat. No. 4,567,945 titled "Electrode Well Method and Apparatus;" and U.S. Pat. No. 5,620,049 titled "Method for Increasing the Production of Petroleum From a Subterranean Formation Penetrated by a Wellbore."

In 1989, U.S. Pat. No. 4,886,118 issued to Shell Oil Company. That patent, entitled "Conductively Heating a Subterranean Oil Shale to Create Permeability and Subsequently Produce Oil," declared that "[c]ontrary to the implications of . . . prior teachings and beliefs . . . the presently described conductive heating process is economically feasible for use even in a substantially impermeable subterranean oil shale." (col. 6, ln. 50-54). Despite this declaration, it is noted that few, if any, commercial in situ shale oil operations have occurred other than Ljungstrom's. Shell's '118 patent proposed controlling the rate of heat conduction within the rock surrounding each heat injection well to provide a uniform heat front. The '118 Shell patent is incorporated herein in its entirety by reference.

Additional history behind oil shale retorting and shale oil recovery can be found in co-owned U.S. Pat. No. 7,331,385 entitled "Methods of Treating a Subterranean Formation to Convert Organic Matter into Producible Hydrocarbons," and in U.S. Pat. No. 7,441,603 entitled "Hydrocarbon Recovery from Impermeable Oil Shales." The Backgrounds and technical disclosures of these two patent publications are incorporated herein by reference.

A need exists for improved processes for the production of shale oil. In addition, a need exists for improved methods for heating organic-rich rock formations in connection with an in situ pyrolyzation process. Still further, a need exists for methods that facilitate an expeditious and effective subsurface heater well arrangement using an electrically conductive granular material placed within an organic-rich rock formation.

SUMMARY OF THE INVENTION

The methods described herein have various benefits in improving the recovery of hydrocarbon fluids from an organic-rich rock formation such as a formation containing heavy hydrocarbons or solid hydrocarbons. In various embodiments, such benefits may include increased production of hydrocarbon fluids from an organic-rich rock formation, and avoiding areas of high electrical resistivity near heat injection wells during formation heating.

A method for heating a subsurface formation using electrical resistance heating is first provided. In one embodiment, the method first includes the step of placing a first electrically conductive proppant into a fracture. The fracture has been formed within an interval of organic-rich rock in the subsurface formation. The organic-rich rock may be, for example, a heavy oil such as bitumen. Alternatively, the organic-rich rock may be oil shale that comprises kerogen.

The first electrically conductive proppant is preferably comprised of metal shavings, steel shot, graphite, calcined coke, or other electrically conductive material. The first proppant has a first bulk resistivity.

The method also includes placing a second electrically conductive proppant into or adjacent the fracture, and in contact with the first proppant. The second electrically conductive proppant also is preferably comprised of metal shavings, steel shot, graphite, or calcined coke. The second proppant has a second bulk resistivity that is lower than the first bulk resistivity.

The second electrically conductive proppant is placed in electrical communication with the first electrically conductive proppant. The electrical communication is provided at three or more distinct terminals. Each terminal provides a local region of relatively high electrical conductivity in comparison to the first electrically conductive proppant. In this way, inordinate heat is not generated proximate the wellbore as the current enters or leaves the fracture.

In one embodiment, the second proppant is continuous and the terminals are simply different locations along a wellbore. In another embodiment, the second proppant provides three or more discrete second proppant portions along a single wellbore. In still another embodiment, the second proppant provides proppant portions within distinct wellbores that intersect the fracture. In any arrangement, each terminal has its own electrically conductive lead extending to the surface.

The method also comprises passing electric current through the second electrically conductive proppant at a first terminal. The current passes through the second electrically conductive proppant and through the first electrically conductive proppant. In this way, heat is generated within the at least one fracture by electrical resistance.

It is understood that the current travels along a circuit that includes an electrical source. Thus, an electrical source is provided at the surface. The electrical source may be electricity obtained from a regional grid. Alternatively, electricity may be generated on-site through a gas turbine or a combined cycle power plant. The circuit will also include an insulated electrical cable, rod, or other device that delivers the current to the selected terminal as an electrically conductive lead.

After passing through the second electrically conductive proppant and then through the first electrically conductive proppant in the fracture, the current travels back to the surface. In returning to the surface, the current may travel back to the first wellbore and return through a separate electrically conductive lead. Alternatively, the current may travel through a separate wellbore to the surface.

The method further includes monitoring resistance. Resistance is monitored at the first terminal while current passes through that location. The method then includes switching the flow of electricity from the first terminal to a second terminal such that electric current is passed through the second electrically conductive proppant at the second terminal, and then through the first electrically conductive proppant to generate heat within the at least one fracture. Switching the terminals may be done to provide a more efficient flow of electrical current through the fracture.

In one aspect of the method, the steps of passing electric current serve to heat the subsurface formation adjacent the at least one fracture to a temperature of at least 300° C. This is sufficient to mobilize heavy hydrocarbons such as bitumen in a tar sands development area. This also is sufficient to pyrolyze solid hydrocarbons into hydrocarbon fluids in a shale oil development area.

A separate method of heating a subsurface formation using electrical resistance heating is also provided herein. The alternate method first includes the step of forming a first wellbore. The first wellbore penetrates an interval of organic-rich rock within the subsurface formation. The wellbore may be a single wellbore completed either vertically or substantially horizontally. Alternatively, the wellbore may be a multi-lateral wellbore wherein more than one deviated production portion is formed from a single parent wellbore.

The method also includes forming at least one fracture in the subsurface formation. The fracture is formed from the first wellbore and within the interval of organic-rich rock.

The method also comprises placing a first electrically conductive proppant into the at least one fracture. The first electrically conductive proppant has a first bulk resistivity. The step of placing the first electrically conductive proppant into the fracture is preferably done by pumping the proppant into the fracture using a hydraulic fluid.

The method also includes placing a second electrically conductive proppant into or adjacent the fracture. The second proppant is placed in contact with the first proppant. The second proppant is tuned to have a second bulk resistivity that is lower than the first bulk resistivity. This permits electrical current to flow from the wellbore without creating undesirable hot spots. Preferably, the resistivity of the first electrically conductive proppant is about 10 to 100 times greater than the resistivity of the second electrically conductive proppant. In one aspect, the resistivity of the first electrically conductive proppant is about 0.005 to 1.0 Ohm-Meters.

The method further includes placing the second electrically conductive proppant in electrical communication with the first electrically conductive proppant. Electrical communication is provided at three or more terminals. In one embodiment, the second proppant is continuous and the terminals are simply different locations along a wellbore. In another embodiment, the second proppant provides three or more discrete proppant portions along a single wellbore. In still another embodiment, the second proppant provides proppant portions within distinct wellbores that intersect the fracture. In any arrangement, each terminal has its own electrically conductive lead extending to the surface.

The method also comprises passing electric current through the second electrically conductive proppant at a first terminal. The current passes through the second electrically conductive proppant and through the first electrically conductive proppant. In this way, heat is generated within the at least one fracture by electrical resistivity.

An electrical source is provided at the surface for the current. The electrical source is designed to generate or otherwise provide an electrical current to the first electrically conductive proppant located within the fracture. The electrical source may be electricity obtained from a regional grid. Alternatively, electricity may be generated on-site through a gas turbine or a combined cycle power plant.

After passing through the second electrically conductive proppant and then through the first electrically conductive proppant in the fracture, the current travels back to the surface. In returning to the surface, the current may travel back to the first wellbore and return through a separate electrically conductive lead at a different terminal. Alternatively, the current may travel through a separate wellbore to the surface.

Current is directed from the electrical source at the surface to the terminals using electrical connections. The electrical connections are preferably insulated copper wires or cables that extend through the wellbore. However, they may alternatively be insulated rods, bars, or metal tubes. The only requirement is that they transmit electrical current down to the interval to be heated, and that they are insulated from one another.

The method also includes switching the flow of electricity from the first terminal to a second terminal. In this way, electric current is passed through the second electrically conductive proppant at the second terminal, and through the first electrically conductive proppant to generate heat within the at least one fracture.

In one aspect of the method, passing electric current through the fracture heats the subsurface formation adjacent the at least one fracture to a temperature of at least 300° C. This is sufficient to mobilize heavy hydrocarbons such as bitumen in a tar sands development area. This also is sufficient to pyrolyze solid hydrocarbons into hydrocarbon fluids in a shale oil development area.

BRIEF DESCRIPTION OF THE DRAWINGS

So that the present inventions can be better understood, certain drawings, charts, graphs and flow charts are appended hereto. It is to be noted, however, that the drawings illustrate only selected embodiments of the inventions and are therefore not to be considered limiting of scope, for the inventions may admit to other equally effective embodiments and applications.

FIG. 2B provides a first cross-sectional view of the two wellbores. Here, each wellbore has been lined with a string of casing. In addition, each wellbore has been perforated along an interval of organic-rich rock.

FIG. 2C provides another cross-sectional view of the wellbores of FIG. 2A. Here, the organic-rich rock is undergoing fracturing. A first electrically conductive proppant has been injected into the wellbores and into the surrounding rock to form a fracture plane.

FIG. 2D presents a next step in the forming of the heater well arrangement. Here, a second electrically conductive proppant has been injected into the two wellbores and partially into the fracture.

FIG. 2E presents yet another step in the forming of the heater well arrangement and the heating of the subsurface formation. Here, electrically conductive leads have been run into the wellbores. Each lead runs from an electrical source at the surface, and terminates at a different terminal in the second electrically conductive proppant.

FIG. 3B provides a first cross-sectional view of the wellbore of FIG. 3A. Here, the wellbore is formed horizontally and has been lined with a string of casing. The wellbore has also been perforated along a deviated portion.

FIG. 3C provides another cross-sectional view of the wellbore. Here, a first electrically conductive proppant is injected into the wellbore and through the perforations in the casing. The first electrically conductive proppant is injected under a pressure greater than a formation-parting pressure in order to form a fracture. The fracture extends into the organic-rich rock along the deviated portion of the wellbore.

FIG. 3D presents a next step in the forming of the heating well arrangement. Here, a second electrically conductive proppant has been injected into the wellbore and into the fracture. The second electrically conductive proppant displaces the first electrically conductive proppant from the bore of the wellbore and extends the fracture plane at multiple discrete locations.

FIG. 3E presents yet another step in the heating of the subsurface formation. Here, electrically conductive leads have been run into the wellbore. Each lead runs from a control at the surface, and terminates at a different terminal in the second electrically conductive proppant.

DETAILED DESCRIPTION OF CERTAIN EMBODIMENTS

Definitions

Figure 1:
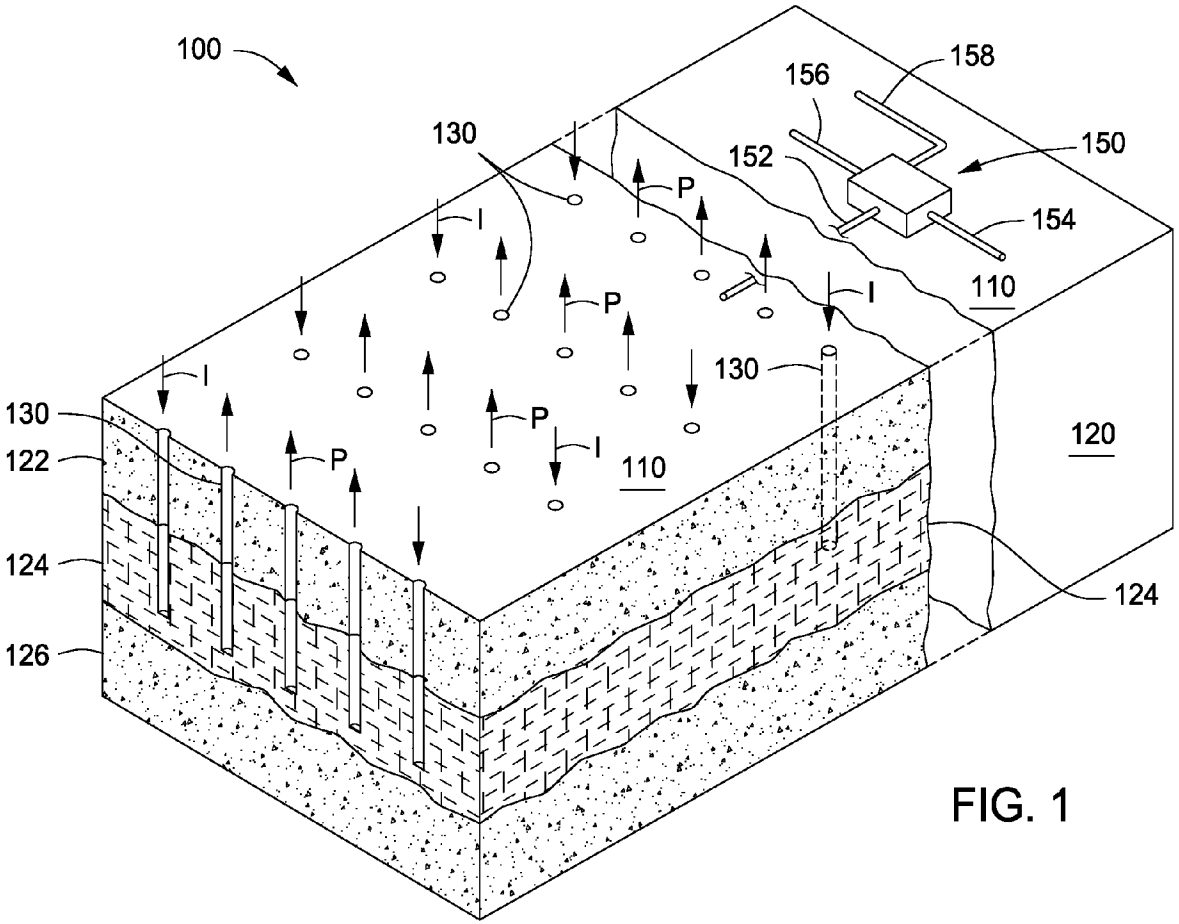
FIG. 1 is a three-dimensional isometric view of an illustrative hydrocarbon development area. The development area includes an organic-rich rock matrix that defines a subsurface formation.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, and combinations of liquids and solids.

As used herein, the term "gas" refers to a fluid that is in its vapor phase at ambient conditions.

As used herein, the term "condensable hydrocarbons" means those hydrocarbons that condense to a liquid at about 15° C. and one atmosphere absolute pressure. Condensable hydrocarbons may include a mixture of hydrocarbons having carbon numbers greater than 4.

As used herein, the term "non-condensable" means those chemical species that do not condense to a liquid at about 15° C. and one atmosphere absolute pressure. Non-condensable species may include non-condensable hydrocarbons and non-condensable non-hydrocarbon species such as, for example, carbon dioxide, hydrogen, carbon monoxide, hydrogen sulfide, and nitrogen. Non-condensable hydrocarbons may include hydrocarbons having carbon numbers less than 5.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10-20 degrees, whereas tar generally has an API gravity below about 10 degrees. The viscosity of heavy hydrocarbons is generally greater than about 100 centipoise at about 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites. A formation that contains formation hydrocarbons may be referred to as an "organic-rich rock."

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that principally contains carbon, hydrogen, nitrogen, oxygen, and sulfur.

As used herein, the term "bitumen" refers to a non-crystalline solid or viscous hydrocarbon material that is substantially soluble in carbon disulfide.

As used herein, the term "oil" refers to a hydrocarbon fluid containing primarily a mixture of condensable hydrocarbons.

As used herein, the term "subsurface" refers to geologic strata occurring below the earth's surface. Similarly, the term "formation" refers to any definable subsurface region. The formation may contain one or more hydrocarbon-containing layers, one or more non-hydrocarbon containing layers, an overburden, and/or an underburden of any geologic formation. An "overburden" and/or an "underburden" is geological material above or below the formation of interest.

An overburden or underburden may include one or more different types of substantially impermeable materials. For example, overburden and/or underburden may include sandstone, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "hydrocarbon-rich formation" refers to any formation that contains more than trace amounts of hydrocarbons. For example, a hydrocarbon-rich formation may include portions that contain hydrocarbons at a level of greater than 5 percent by volume. The hydrocarbons located in a hydrocarbon-rich formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen or bitumen.

As used herein, the term "organic-rich rock formation" refers to any formation containing organic-rich rock. Organic-rich rock formations include, for example, oil shale formations, coal formations, and tar sands formations.

As used herein, the term "pyrolysis" refers to the breaking of chemical bonds through the application of heat. For example, pyrolysis may include transforming a compound into one or more other substances by heat alone or by heat in combination with a catalyst. Pyrolysis may include modifying the nature of the compound by addition of hydrogen atoms which may be obtained from molecular hydrogen, water, or other hydrocarbon-bearing compound. Heat may be transferred to a section of the formation to cause pyrolysis.

As used herein, the term "hydraulic fracture" refers to a fracture at least partially propagated into a formation, wherein the fracture is created through injection of pressurized fluids into the formation. While the term "hydraulic fracture" is used, the inventions herein are not limited to use in hydraulic fractures. The invention is suitable for use in any fracture created in any manner considered to be suitable by one skilled in the art. The fracture may be artificially held open by injection of a proppant material. Hydraulic fractures may be substantially horizontal in orientation, substantially vertical in orientation, or oriented along any other plane.

As used herein, the term "monitor" or "monitoring" means taking one or more measurements in real time. Monitoring may be done by an operator, or may be done using control software. In one aspect, monitoring means taking measurements to calculate an average resistance over a designated period of time.

As used herein, the term "wellbore" refers to a hole in the subsurface made by drilling or insertion of a conduit into the subsurface. A wellbore may have a substantially circular cross section, or other cross-sectional shape (e.g., an oval, a square, a rectangle, a triangle, or other regular or irregular shapes). As used herein, the term "well", when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

FIG. 1 is a cross-sectional perspective view of an illustrative hydrocarbon development area 100. The hydrocarbon development area 100 has a surface 110. Preferably, the surface 110 is an earth surface on land. However, the surface 110 may be a seabed under a body of water, such as a lake or an ocean.

The hydrocarbon development area 100 also has a subsurface 120. The subsurface 120 includes various formations, including one or more near-surface formations 122, a hydrocarbon-bearing formation 124, and one or more non-hydrocarbon formations 126. The near surface formations 122 represent an overburden, while the non-hydrocarbon formations 126 represent an underburden. Both the one or more near-surface formations 122 and the non-hydrocarbon formations 126 will typically have various strata with different mineralogies therein.

The hydrocarbon development area 100 is for the purpose of producing hydrocarbon fluids from the hydrocarbon-bearing formation 124. The hydrocarbon-bearing formation 124 defines a rock matrix having hydrocarbons residing therein. The hydrocarbons may be solid hydrocarbons such as kerogen. Alternatively, the hydrocarbons may be viscous hydrocarbons such as heavy oil that do not readily flow at formation conditions. The hydrocarbon-bearing formation 124 may also contain, for example, tar sands that are too deep for economical open pit mining. Therefore, an enhanced oil recovery method involving heating is desirable.

It is understood that the representative formation 124 may be any organic-rich rock formation, including a rock matrix containing kerogen, for example. In addition, the rock matrix making up the formation 124 may be permeable, semi-permeable or non-permeable. The present inventions are particularly advantageous in shale oil development areas initially having very limited or effectively no fluid permeability. For example, initial permeability may be less than 10 millidarcies.

The hydrocarbon-bearing formation 124 may be selected for development based on various factors. One such factor is the thickness of organic-rich rock layers or sections within the formation 124. Greater pay zone thickness may indicate a greater potential volumetric production of hydrocarbon fluids. Each of the hydrocarbon-containing layers within the formation 124 may have a thickness that varies depending on, for example, conditions under which the organic-rich rock layer was formed. Therefore, an organic-rich rock formation such as hydrocarbon-bearing formation 124 will typically be selected for treatment if that formation includes at least one hydrocarbon-containing section having a thickness sufficient for economical production of hydrocarbon fluids.

The richness of one or more sections in the hydrocarbon-bearing formation 124 may also be considered. For an oil shale formation, richness is generally a function of the kerogen content. The kerogen content of the oil shale formation may be ascertained from outcrop or core samples using a variety of data. Such data may include Total Organic Carbon content, hydrogen index, and modified Fischer Assay analyses. The Fischer Assay is a standard method which involves heating a sample of a hydrocarbon-containing-layer to approximately 500° C. in one hour, collecting fluids produced from the heated sample, and quantifying the amount of fluids produced.

An organic-rich rock formation such as formation 124 may be chosen for development based on the permeability or porosity of the formation matrix even if the thickness of the formation 124 is relatively thin. Subsurface permeability may also be assessed via rock samples, outcrops, or studies of ground water flow. An organic-rich rock formation may be rejected if there appears to be vertical continuity and connectivity with groundwater.

Other factors known to petroleum engineers may be taken into consideration when selecting a formation for development. Such factors include depth of the perceived pay zone, continuity of thickness, and other factors. For instance, the organic content or richness of rock within a formation will effect eventual volumetric production.

In order to access the hydrocarbon-bearing formation 124 and recover natural resources therefrom, a plurality of wellbores is formed. The wellbores are shown at 130, with some wellbores 130 being seen in cut-away and one being shown in phantom. The wellbores 130 extend from the surface 110 into the formation 124.

Each of the wellbores 130 in FIG. 1 has either an up arrow or a down arrow associated with it. The up arrows indicate that the associated wellbore 130 is a production well. Some of these up arrows are indicated with a "P." The production wells "P" produce hydrocarbon fluids from the hydrocarbon-bearing formation 124 to the surface 110. Reciprocally, the down arrows indicate that the associated wellbore 130 is a heat injection well, or a heater well. Some of these down arrows are indicated with an "I." The heat injection wells "I" inject heat into the hydrocarbon-bearing formation 124. Heat injection may be accomplished in a number of ways known in the art, including downhole or in situ electrically resistive heat sources, circulation of hot fluids through the wellbore or through the formation, and downhole combustion burners.

In one aspect, the purpose for heating the organic-rich rock in the formation 124 is to pyrolyze at least a portion of solid formation hydrocarbons to create hydrocarbon fluids. The organic-rich rock in the formation 124 is heated to a temperature sufficient to pyrolyze at least a portion of the oil shale (or other solid hydrocarbons) in order to convert the kerogen (or other organic-rich rock) to hydrocarbon fluids. In either instance, the resulting hydrocarbon liquids and gases may be refined into products which resemble common commercial petroleum products. Such liquid products include transportation fuels such as gasoline, diesel, jet fuel and naphtha. Generated gases may include light alkanes, light alkenes, $H_2$, $CO_2$, CO, and $NH_3$.

The solid formation hydrocarbons may be pyrolyzed in situ by raising the organic-rich rock in the formation 124, (or heated zones within the formation), to a pyrolyzation temperature. In certain embodiments, the temperature of the formation 124 may be slowly raised through the pyrolysis temperature range. For example, an in situ conversion process may include heating at least a portion of the formation 124 to raise the average temperature of one or more sections above about 270° C. at a rate less than a selected amount (e.g., about 10° C., 5° C.; 3° C., 1° C., or 0.5° C.) per day. In a further embodiment, the portion may be heated such that an average temperature of one or more selected zones over a one month period is less than about 375° C. or, in some embodiments, less than about 400° C.

The hydrocarbon-rich formation 124 may be heated such that a temperature within the formation reaches (at least) an initial pyrolyzation temperature, that is, a temperature at the lower end of the temperature range where pyrolyzation begins to occur. The pyrolysis temperature range may vary depending on the types of formation hydrocarbons within the formation, the heating methodology, and the distribution of heating sources. For example, a pyrolysis temperature range may include temperatures between about 270° C. and 800° C. In one aspect, the bulk of a target zone of the formation 124 may be heated to between 300° C. and 600° C.

For in situ operations, the heating and conversion process occurs over a lengthy period of time. In one aspect, the heating period is from three months to four or more years.

Conversion of oil shale into hydrocarbon fluids will create permeability in rocks in the formation 124 that were originally substantially impermeable. For example, permeability may increase due to formation of thermal fractures within a heated portion caused by application of heat. As the temperature of the heated formation 124 increases, water may be removed due to vaporization. The vaporized water may escape and/or be removed from the formation 124 through the production wells "P." In addition, permeability of the formation 124 may also increase as a result of production of hydrocarbon fluids generated from pyrolysis of at least some of the formation hydrocarbons on a macroscopic scale. For example, pyrolyzing at least a portion of an organic-rich rock formation may increase permeability within a selected zone to about 1 millidarcy, alternatively, greater than about 10 millidarcies, 50 millidarcies, 100 millidarcies, 1 Darcy, 10 Darcies, 20 Darcies, or even 50 Darcies.

It is understood that petroleum engineers will develop a strategy for the best depth and arrangement for the wellbores 130 depending upon anticipated reservoir characteristics, economic constraints, and work scheduling constraints. In addition, engineering staff will determine what wellbores "I" should be formed for initial formation heating.

In an alternative embodiment, the purpose for heating the rock in the formation 124 is to mobilize viscous hydrocarbons. The rock in the formation 124 is heated to a temperature sufficient to liquefy bitumen or other heavy hydrocarbons so that they flow to a production well "P." The resulting hydrocarbon liquids and gases may be refined into products which resemble common commercial petroleum products. Such liquid products include transportation fuels such as diesel, jet fuel and naphtha. Generated gases may include light alkanes, light alkenes, $H_2$, $CO_2$, CO, and $NH_3$. For bitumen, the resulting hydrocarbon liquids may be used for road paving and surface sealing.

In the illustrative hydrocarbon development area 100, the wellbores 130 are arranged in rows. The production wells "P" are in rows, and the heat injection wells "I" are in adjacent rows. This is referred to in the industry as a "line drive" arrangement. However, other geometric arrangements may be used such as a 5-spot arrangement. The inventions disclosed herein are not limited to the arrangement of production wells "P" and heat injection wells "I" unless so stated in the claims.

In the arrangement of FIG. 1, each of the wellbores 130 is completed in the hydrocarbon-bearing formation 124. The various wellbores 130 are presented as having been completed substantially vertically. However, it is understood that some or all of the wellbores 130, particularly for the production wells "P," could be deviated into an obtuse or even horizontal orientation.

In the view of FIG. 1, only eight wellbores 130 are shown for the heat injection wells "I." Likewise, only twelve wellbores 130 are shown for the production wells "P." However, it is understood that in an oil shale development project or in a heavy oil production operation, numerous additional wellbores 130 will be drilled. In addition, separate wellbores (not shown) may optionally be formed for water injection, formation freezing, and sensing or data collection.

The production wells "P" and the heat injection wells "I" are also arranged at a pre-determined spacing. In some embodiments, a well spacing of 15 to 25 feet is provided for the various wellbores 130. The claims disclosed below are not limited to the spacing of the production wells "P" or the heat injection wells "I" unless otherwise stated. In general, the wellbores 130 may be from about 10 feet up to even about 300 feet in separation.

Typically, the wellbores 130 are completed at shallow depths. Completion depths may range from 200 to 5,000 feet at true vertical depth. In some embodiments, an oil shale formation targeted for in situ retorting is at a depth greater than 200 feet below the surface, or alternatively 400 feet below the surface. Alternatively, conversion and production occur at depths between 500 and 2,500 feet.

A production fluids processing facility 150 is also shown schematically in FIG. 1. The processing facility 150 is designed to receive fluids produced from the organic-rich rock of the formation 124 through one or more pipelines or flow lines 152. The fluid processing facility 150 may include equipment suitable for receiving and separating oil, gas, and water produced from the heated formation 124. The fluids processing facility 150 may further include equipment for separating out dissolved water-soluble minerals and/or migratory contaminant species, including, for example, dissolved organic contaminants, metal contaminants, or ionic contaminants in the produced water recovered from the organic-rich rock formation 124.

FIG. 1 shows three exit lines 154, 156, and 158. The exit lines 154, 156, 158 carry fluids from the fluids processing facility 150. Exit line 154 carries oil; exit line 156 carries gas; and exit line 158 carries separated water. The water may be treated and, optionally, re-injected into the hydrocarbon-bearing formation 124 as steam for further enhanced oil recovery. Alternatively, the water may be circulated through the hydrocarbon-bearing formation at the conclusion of the production process as part of a subsurface reclamation project.

In order to carry out the process described above in connection with FIG. 1, it is necessary to heat the subsurface formation 124. A preferred method offered herein is to employ heater wells "I" that generate electrically resistive heat.

As alluded to above, several designs have been previously offered for electrical heater wells. One example is found in U.S. Pat. No. 3,137,347 titled "In Situ Electrolinking of Oil Shale." The '347 patent describes a method by which electric current is flowed through a fracture connecting two wells to get electric flow started in the bulk of the surrounding formation. Of interest, heating of the formation occurs primarily due to the bulk electrical resistance of the formation itself. F. S. Chute and F. E. Vermeulen, *Present and Potential Applications of Electromagnetic Heating in the In Situ Recovery of Oil*, AOSTRA J. Res., v. 4, p. 19-33 (1988) describes a heavy-oil pilot test where "electric preheat" was used to flow electric current between two wells to lower viscosity and create communication channels between wells for follow-up with a steam flood.

Another example is found in U.S. Pat. No. 7,331,385, mentioned briefly above. That patent is entitled "Methods of Treating a Subterranean Formation to Convert Organic Matter into Producible Hydrocarbons." The '385 patent teaches the use of electrically conductive fractures to heat oil shale. According to the '385 patent, a heating element is constructed by forming wellbores in a formation, and then hydraulically fracturing the oil shale formation around the wellbores. The fractures are filled with an electrically conductive material which forms the heating element. Preferably, the fractures are created in a vertical orientation extending from horizontal wellbores. An electrical current is passed through the conductive fractures from about the heel to the toe of each well. To facilitate the current, an electrical circuit may be completed by an additional transverse horizontal well that intersects one or more of the vertical fractures. The process of U.S. Pat. No. 7,331,385 creates an "in situ toaster" that artificially matures oil shale through the application of electric heat. Thermal conduction heats the oil shale to conversion temperatures in excess of about 300° C., causing artificial maturation.

Yet another example of electrical heating is disclosed in U.S. Patent Publ. No. 2008/0271885 published on Nov. 6, 2008. This publication is entitled "Granular Electrical Connections for In Situ Formation Heating." In this publication, a resistive heater is formed by placing an electrically conductive granular material within a passage formed along a subsurface formation and proximate a stratum to be heated. In this disclosure, two or three wellbores are completed within the subsurface formation. Each wellbore includes an electrically conductive member. The electrically conductive member in each wellbore may be, for example, a metal rod, a metal bar, a metal pipe, a wire, or an insulated cable. The electrically conductive members extend into the stratum to be heated.

Passages are also formed in the stratum creating fluid communication between the wellbores. In some embodiments, the passage is an inter-connecting fracture; in other embodiments, the passage is one or more inter-connecting bores drilled through the formation. Electrically conductive granular material is then injected, deposited, or otherwise placed within the passages to provide electrical communication between the electrically conductive members of the adjacent wellbores.

In operation, a current is passed between the electrically conductive members. Passing current through the electrically conductive members and the intermediate granular material causes resistive heat to be generated primarily from the electrically conductive members within the wellbores. FIGS. 30A through 33 of U.S. Patent Publ. No. 2008/0271885 are instructive in this regard.

U.S. Patent Publ. No. 2008/0230219 describes other embodiments wherein the passage between adjacent wellbores is a drilled passage. In this manner, the lower ends of adjacent wellbores are in fluid communication. A conductive granular material is then injected, poured or otherwise placed in the passage such that granular material resides in both the wellbores and the drilled passage. In operation, a current is again passed through the electrically conductive members and the intermediate granular material to generate resistive heat. However, in U.S. Patent Publ. No. 2008/0230219, the resistive heat is generated primarily from the granular material. FIGS. 34A and 34B are instructive in this regard.

U.S. Patent Publ. No. 2008/0230219 also describes individual heater wells having two electrically conductive members therein. The electrically conductive members are placed in electrical communication by conductive granular material placed within the wellbore at the depth of a formation to be heated. Heating occurs primarily from the electrically conductive granular material within the individual wellbores. These embodiments are shown in FIGS. 30A, 31A, 32, and 33.

In one embodiment, the electrically conductive granular material is interspersed with slugs of highly conductive granular material in regions where no or minimal heating is desired. Materials with greater conductivity may include metal filings or shot; materials with lower conductivity may include quartz sand, ceramic particles, clays, gravel, or cement.

Co-owned U.S. Pat. Publ. No. 2010/0101793 is also instructive. That application was published on 29 Apr. 2010 and is entitled "Electrically Conductive Methods for Heating a Subsurface Formation to Convert Organic Matter into Hydrocarbon Fluids." The published application teaches the use of two or more materials placed within an organic-rich rock formation and having varying properties of electrical resistance. Specifically, the granular material placed proximate the wellbore is highly conductive, while the granular material injected into a surrounding fracture is more resistive. An electrical current is passed through the granular material in the formation to generate resistive heat. The materials placed in situ provide for resistive heat without creating hot spots near the wellbores.

Co-owned U.S. Pat. No. 7,331,385, U.S. Pat. Publ. No. 2010/0101793, and U.S. Patent Publ. No. 2008/0230219 each present efficient means for forming wellbores used for generating electrically resistive heat. However, each also preferably requires the use of two or more wellbores completed in close proximity with intersecting materials. Therefore, it is desirable to reduce the number of wells to be drilled while still taking advantage of the efficiencies offered through the use of conductive granular material.

Figure 2A:
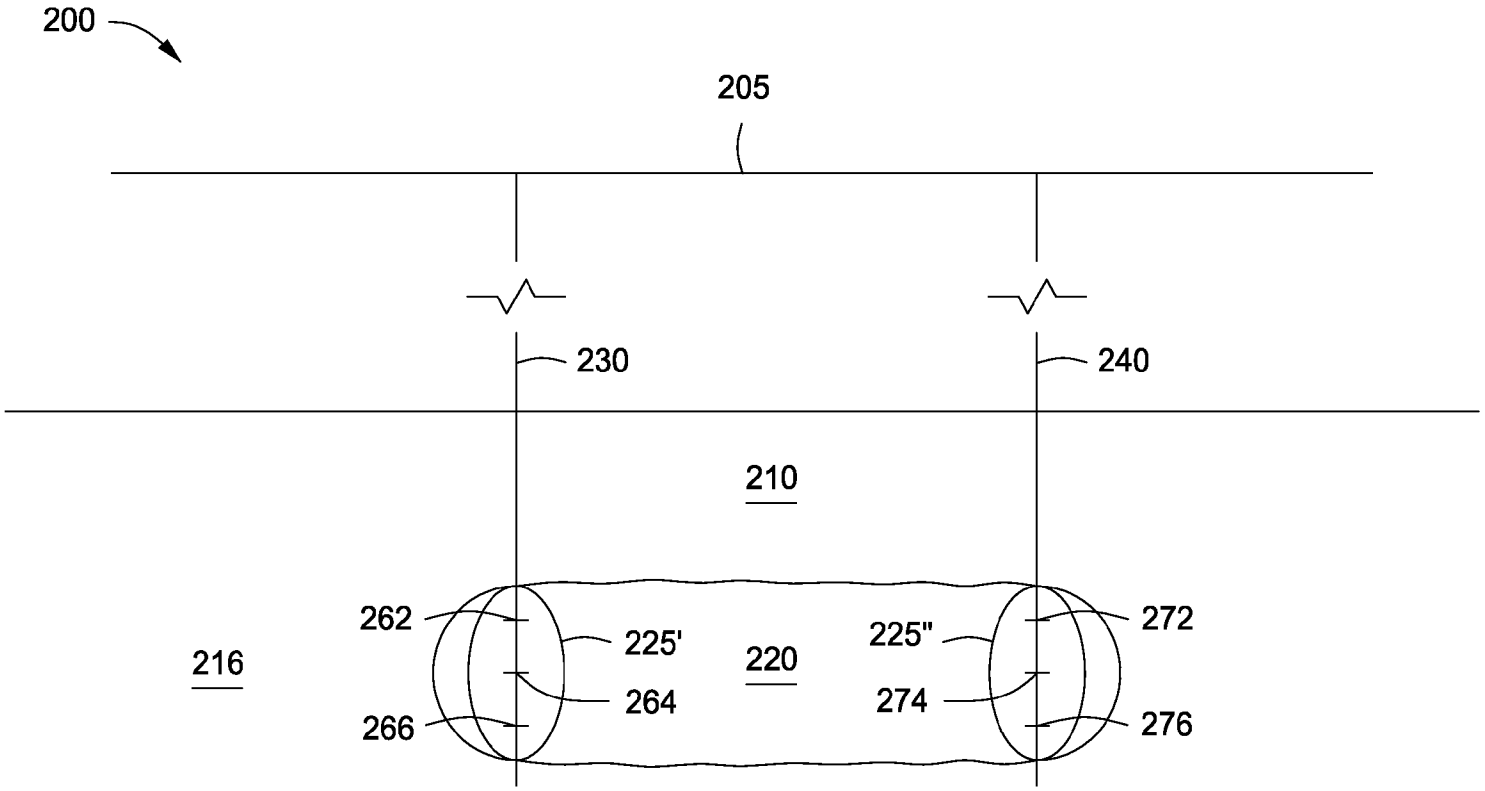
FIG. 2A is a side, schematic view of a heater well arrangement that uses two adjacent heat injection wells. The wells are linked by a subsurface fracture. At least one of the wells employs multiple electrical terminals to allow an operator to select a path of current into or out of a fracture.
Figure 3A:
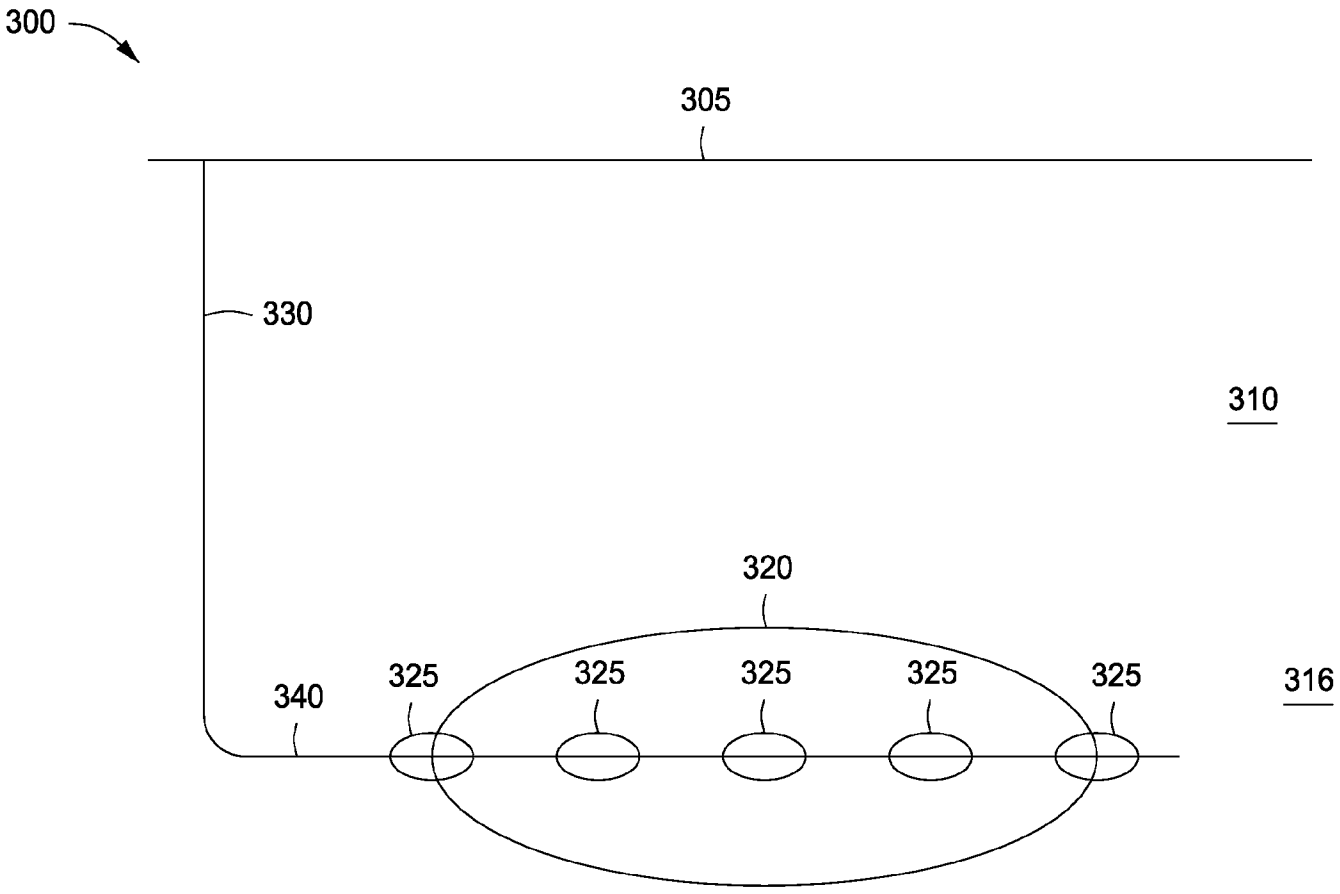
FIG. 3A is a side, schematic view of a heater well arrangement that uses a single heat injection well. A fracture has been formed in a subsurface formation from the single well. The well employs multiple electrical terminals to allow an operator to select a path of current into and out of the fracture.
Figure 4:
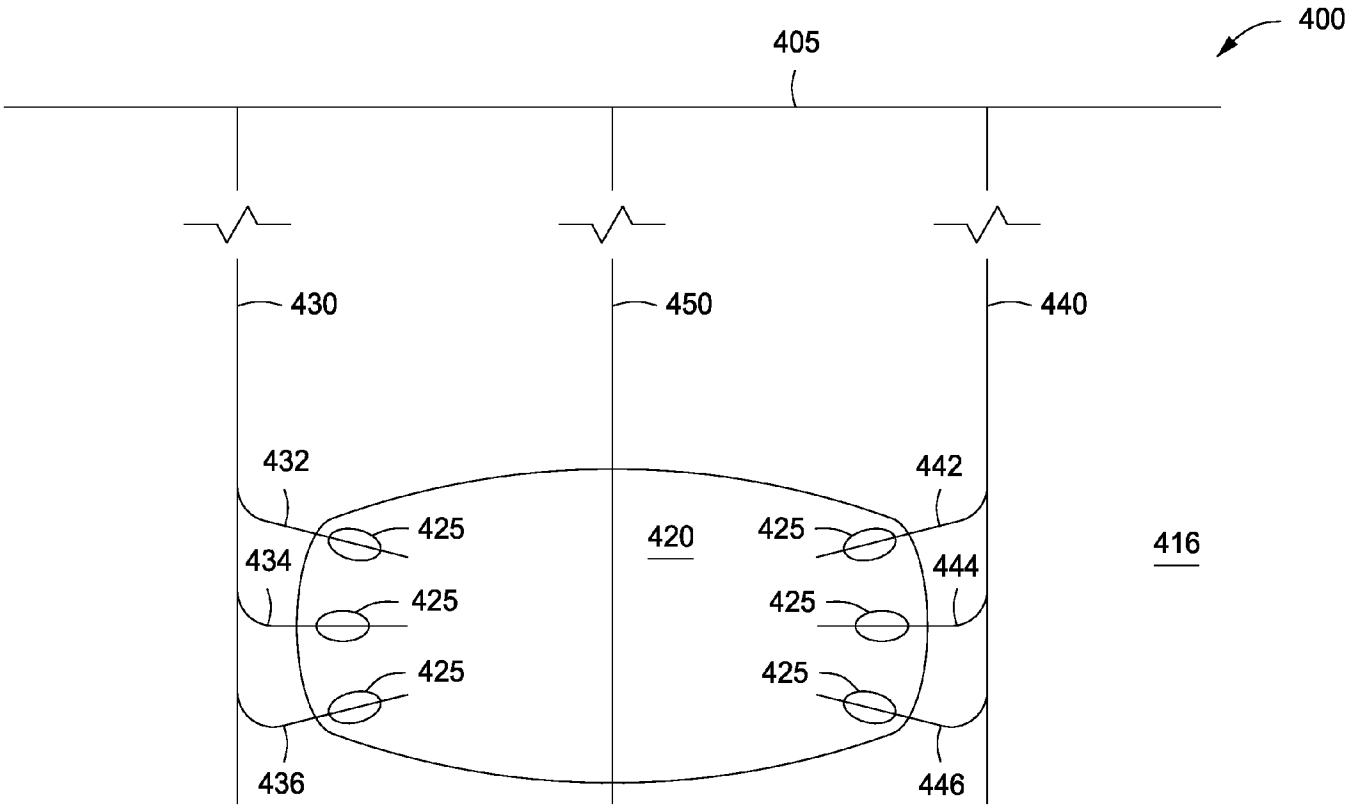
FIG. 4 is a side, schematic view of a heater well arrangement that uses multiple heat injection wells, in one embodiment. The wells intersect a subsurface fracture having electrically conductive proppant. At least one of the wells employs multiple electrical terminals to allow an operator to select a path of current into or out of a fracture. Here, the multiple terminals are provided through distinct lateral boreholes.

Additional wellbore arrangements and methods for heating a formation containing organic-rich rock using electrically conductive granular material are offered herein. FIGS. 2A, 3A and 4 present side, schematic views of heater well arrangements 200, 300, 400. The purpose for the heater well arrangements is to heat illustrative organic-rich rock formations 216, 316, 416, and thereby pyrolyze solid hydrocarbon or mobilize hydrocarbon fluids therein.

Referring now to FIG. 2A, a first heater well arrangement 200 is shown. The heater well arrangement 200 is for the purpose of heating the organic-rich rock formation 216, and thereby facilitate the production of hydrocarbon fluids. Hydrocarbon fluids are produced to the surface through production wells, such as wells "P" shown in FIG. 1, above.

In one aspect, the organic-rich rock formation 216 comprises solid hydrocarbons. Examples of solid hydrocarbons include kerogen, shungites, and natural mineral waxes. In this instance, heating the organic-rich rock formation 216 pyrolyzes the solid hydrocarbons into hydrocarbon fluids. The hydrocarbon fluids may then be produced through production wells to an earth surface 205 for further processing and commercial sale.

In another aspect, the organic-rich rock formation 216 comprises heavy hydrocarbons such as heavy oil, tar, and/or asphalt. The heavy oil might make up a so-called "tar sands" formation. In this instance, heating the organic-rich rock formation 216 serves to mobilize bitumen or tar so that hydrocarbons may flow as a fluid through production wells (not shown) to the surface 205.

In the arrangement of FIG. 2A, two separate wellbores 230, 240 extend from the earth surface 205 and into the organic-rich rock formation 216. Each wellbore 230, 240 is shown as having been completed vertically. However, it is understood that each wellbore 230, 240 may be completed as a deviated wellbore, or even as a horizontal wellbore. It is desirable though that the orientation of least principal stress within the subsurface formation permits a linking of fractures from each wellbore 230, 240 to form one fracture.

Pressure gauges at the surface 205 should inform the operator when a linking of fractures has taken place. In this respect, the operator will observe a drop in pressure as fracturing fluid injected into one wellbore begins to communicate with the fracture formed from the other wellbore Linking the two fractures allows for an electrically conductive proppant to become a single electrically conductive body. The merger of two fracture planes is called coalescence. The concept of fracture coalescence has been discussed in SPE Paper No. 27, 718, published in 1994. See K. E. Olson and A. W. M. El-Rabaa, "*Hydraulic Fracturing of the Multizone Wells in the Pegasus* (*Devonian*) Field, West Texas," SPE Paper No. 27, 718 (Mar. 16-18, 1994).

In FIG. 2A, a fracture 220 has been created between the two wellbores 230, 240. Hydraulic fracturing is a process known in the art of wellbore completions wherein an injection fluid is pressurized within the wellbore above the fracture pressure of the formation. This develops one or more fracture planes within the surrounding rock to relieve the pressure generated within the wellbore. Hydraulic fractures are oftentimes used to create additional permeability along a production portion of a formation. In the present context, the hydraulic fracturing is used to provide a planar source for heating.

It is important to note that the fracture 220 extends parallel to the wellbores 230, 240. Because the wellbores 230, 240 are vertical, this means the plane of the fracture 220 is formed at a depth where the fracture plane is also oriented vertically. According to principles of geomechanics, fracture planes tend to form in a direction perpendicular to the direction of least minimum principal stress. For formations that are less than 1,000 feet, for example, fracture planes typically tend to form horizontally. For formations that are greater than about 1,000 feet in depth, fracture planes tend to form vertically. Thus, the vertical wellbore embodiment shown in FIG. 2A (and FIGS. 2B through 2E) would preferably be used for the heating of organic-rich rock formations that are deep, i.e., greater than about 305 meters (1,000 feet).

The fracture 220 contains a first electrically conductive proppant (not shown). The first proppant is placed in the fracture 220 by injecting a hydraulic fluid containing the proppant through the wellbores 230, 240. The hydraulic fluid is injected into the subsurface formation 210 at a pressure that exceeds a formation parting pressure, as is known in the art. A first electrically conductive proppant fills the fracture plane 220. The first electrically conductive proppant is carried into the wellbores 230, 240, through respective perforations, and into the fracture 220 via hydraulic fluid or other carrier medium.

In the heater well arrangement 200 of FIG. 2A, a second electrically conductive proppant has been injected into each wellbore 230, 240. The second proppant has also been injected partially into the newly-formed fracture 220 from each wellbore 230, 240. The zone of injection for the second proppant is indicated by zones 225', 225". The second electrically conductive proppant partially displaces, overlaps, or mixes with the first electrically conductive proppant to form the zones 225', 225".

In accordance with the methods herein, the first electrically conductive proppant has a first bulk resistivity. Similarly, the second electrically conductive proppant has a second bulk resistivity. The second bulk resistivity is lower than the first bulk resistivity, meaning that the second electrically conductive proppant is more electrically conductive than the first electrically conductive proppant. This beneficially serves to prevent regions of excess heating, or "hot spots," that might naturally occur in connection with the flow of electricity into and out of the fracture 220.

The combination of the two wellbores 230, 240 along with the linking fracture 220 and the placement of first and second electrically conductive proppants provide a useful heater well arrangement 200. In order to heat the organic-rich rock formation 216 using the heater well arrangement 200, electric current is passed from the surface 205 and down the first wellbore 230, through the second proppant in zone 225', through the first proppant in fracture 220, through the second proppant in zone 225", and up the second wellbore 240. In this manner, the organic-rich rock formation 216 may be heated from the fracture 220 using electrically resistive heating.

Figure 2B:
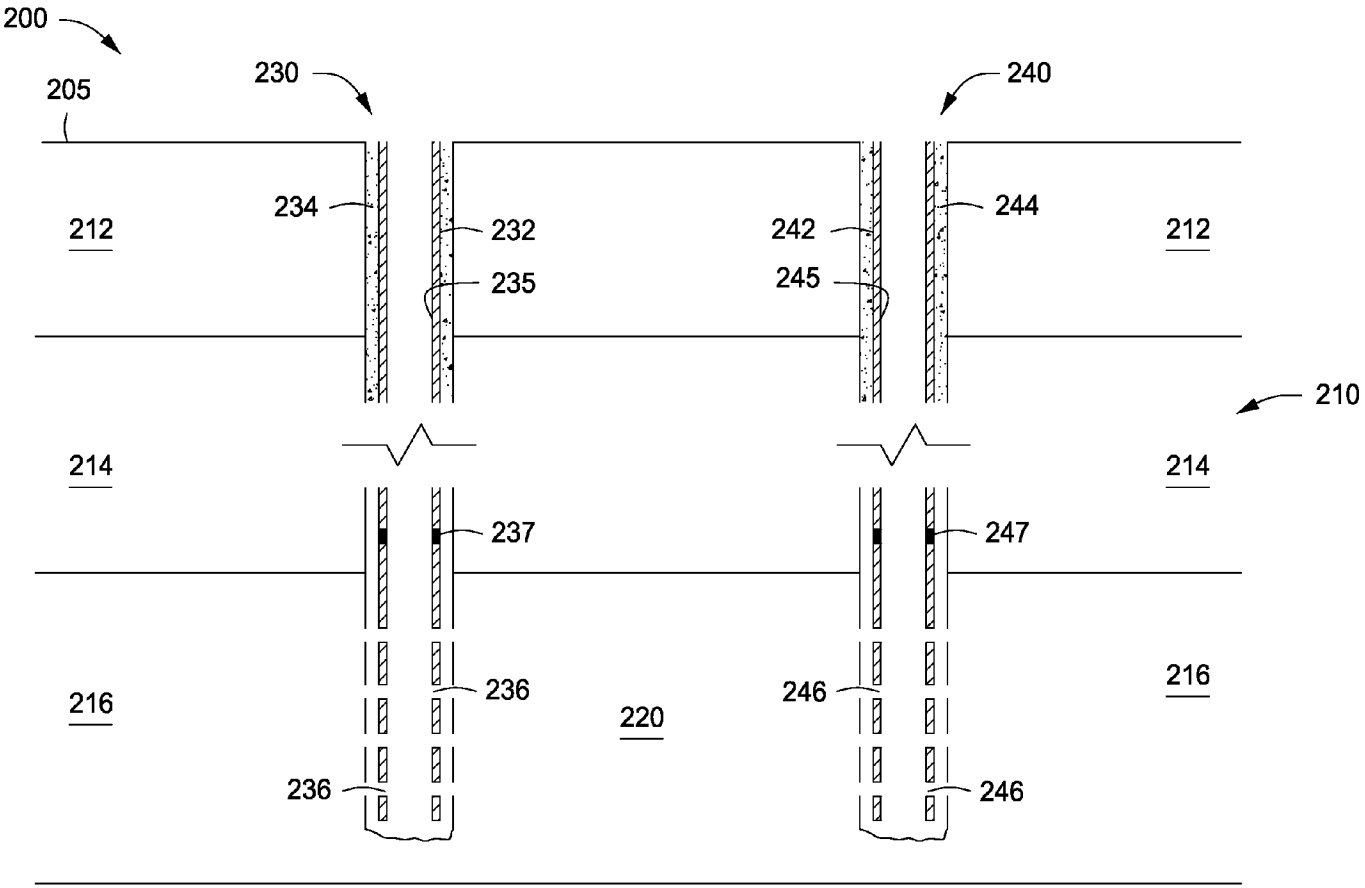
FIGS. 2B through 2E provide side, cross-sectional views of the wells of FIG. 2A. Two wellbores are shown that penetrate into an interval of organic-rich rock in a subsurface formation. The wellbores have been formed for the purpose of heating the organic-rich rock using resistive heating.

Additional details of the heater well arrangement 200 are shown in the progressive views of FIGS. 2B through 2E. First, FIG. 2B provides a side, cross-sectional view of the two adjacent heat injection wells 230, 240. The wells 230, 240 are shown as wellbores that penetrate through the subsurface formation 210. Specifically, the wellbores 230, 240 have been formed through a near surface formation 212, through an intermediate formation 214, and through one or more intervals of organic-rich rock 216 within the subsurface formation 210.

Wellbore 230 has been completed with a string of casing 232. The string of casing 232 defines a bore 235 through which fluids may be injected or equipment may be placed. The casing 232 is secured in place with a cement sheath 234. The cement sheath 234 resides within an annular region formed between the casing 232 and the surrounding near-surface formation 212. The cement sheath 234 isolates any aquifers or sensitive zones along the near-surface formation 212.

Similarly, wellbore 240 has been completed with a string of casing 242. The string of casing 242 defines a bore 245 through which fluids may be injected or equipment may be placed. The casing 242 is secured in place with a cement sheath 244. The cement sheath 244 resides within an annular region formed between the casing 242 and the surrounding near-surface formation 212. The cement sheath 244 isolates any aquifers or sensitive zones along the near-surface formation 212.

Wellbore 230 has been perforated along the organic-rich rock 216. Perforations are shown at 236. Similarly, wellbore 240 has been perforated along the organic-rich rock 216, with perforations shown at 246.

Figure 2C:
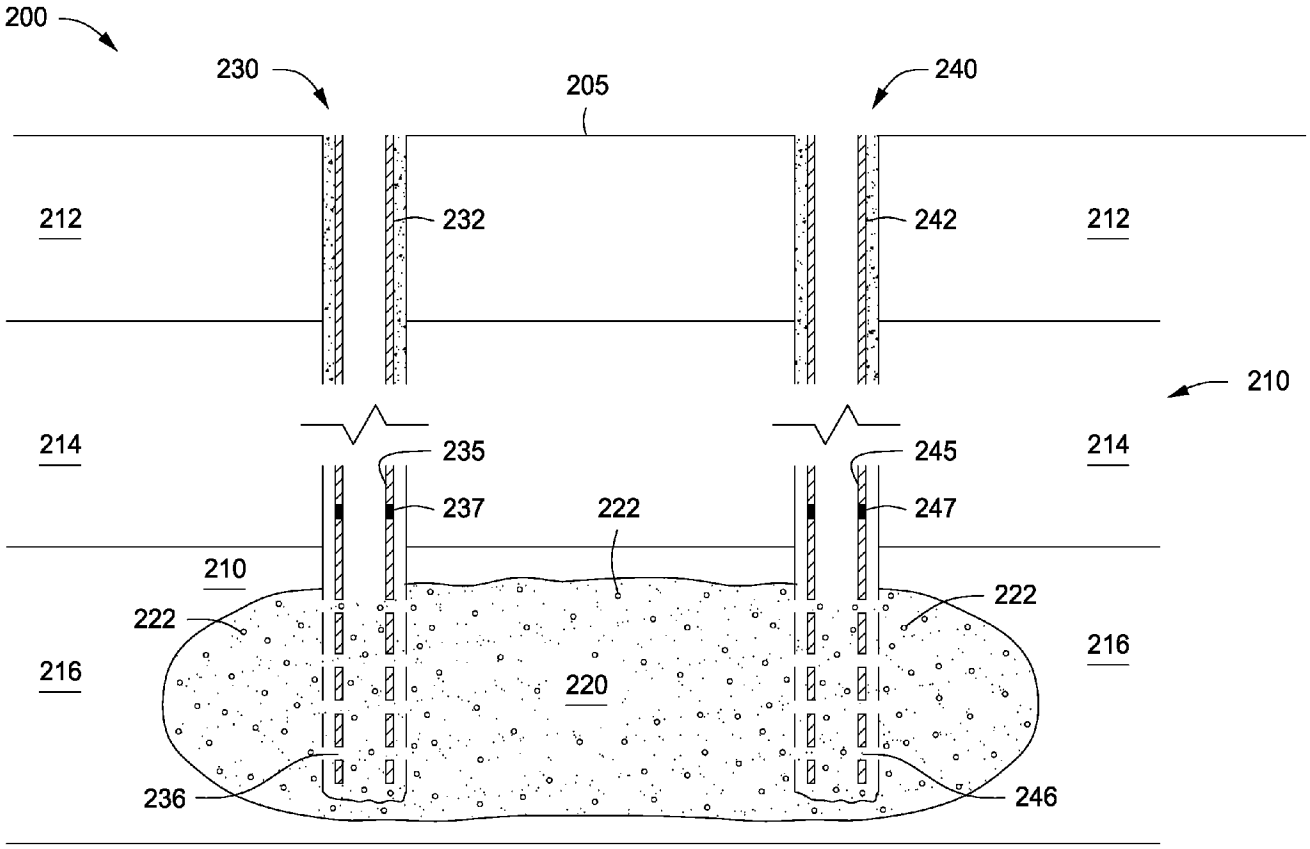

Moving now to FIG. 2C, FIG. 2C provides another cross-sectional view of the wellbores 230, 240 of FIG. 2B. Here, the organic-rich rock 216 is undergoing fracturing. The fracture 220 has been formed at the depth of the organic-rich rock 216.

In order to form the fracture 220, a hydraulic fluid laden with proppant is injected through the perforations 236, 246. The injection is at a pressure greater than the parting pressure of the subsurface formation 210. The proppant comprises electrically conductive particles such as metal shavings, steel shot, calcined coke, metal coated particles, graphite, or combinations thereof. The hydraulic fluid laden with proppant leaves a first electrically conductive proppant 222 within the fracture 220.

Figure 2D:
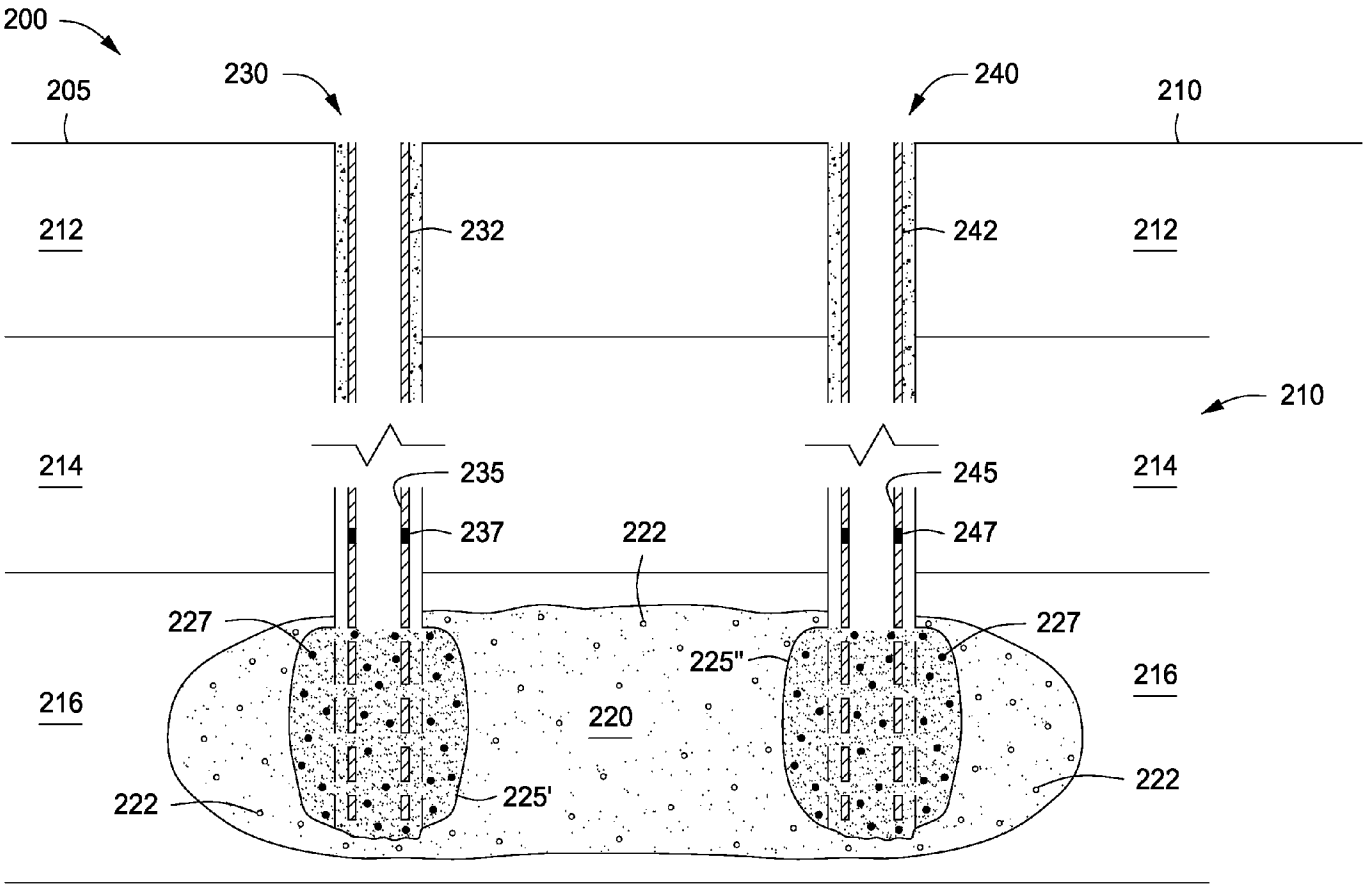

FIG. 2D presents a next step in the formation of the heater well arrangement 200. Here, a second electrically conductive proppant 227 has been injected into the two wellbores 230, 240 and at least partially into the fracture 220. In order to place the second proppant 227, a hydraulic fluid laden with proppant is injected through the perforations 236, 246. The injection is again at a pressure greater than the parting pressure of the subsurface formation 210. The proppant comprises electrically conductive particles such as metal shavings, steel shot, calcined coke, metal coated particles, graphite, or combinations thereof. The hydraulic fluid laden with proppant leaves the second electrically conductive proppant 227 within the fracture 220.

It can be seen in FIG. 2D that the injection of the second proppant 227 leaves two zones of injection 225', 225". Zone 225' extends from wellbore 230, while zone 225" extends from wellbore 240. Each zone 225', 225" preferably invades the fracture 220 to ensure good contact by the second electrically conductive proppant 227 with the first electrically conductive proppant 222.

Figure 2E:
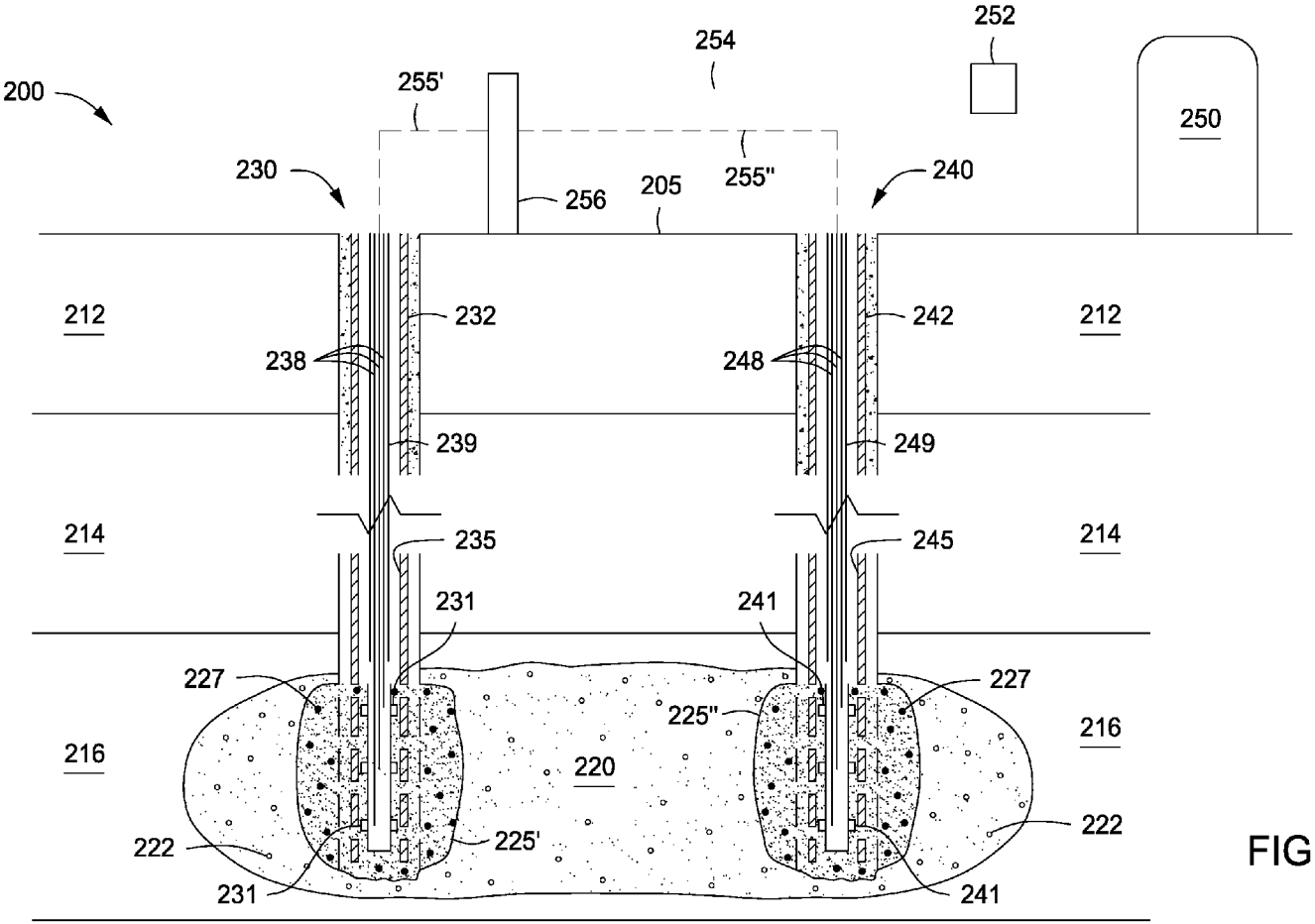

FIG. 2E presents yet another step in the forming of the heater well arrangement 200 and the heating of the organic-rich rock 216. Here, electrically conductive leads 238, 248 have been run into the respective wellbores 230, 240. The leads 238, 248 are preferably bundled into sheaths 239, 249, respectively.

Each lead 238, 248 is preferably a copper or other metal wire protected within its own insulated cover. However, the leads 238, 248 may alternatively be steel rods, pipes, bars or cables that are insulated down to the subsurface formation 210. In any embodiment, the leads 238, 248 have a tip that is exposed to the second electrically conductive proppant 227.

As an additional feature to the heater well arrangement 200, at least one of the wellbores 230, 240 includes three or more terminals. In the wellbore 230, terminals are indicated at 231, while in the wellbore 240 terminals are indicated at 241. Individual leads 238 extend down to respective terminals 231, while individual leads 248 extend down to respective terminals 241. In this way, current may be passed into the second electrically conductive proppant 227 through wellbore 230 at one of the selected terminals 231, while current may be passed out of the second electrically conductive proppant 227 through wellbore 240 at one of the selected terminals 241.

Figure 2F:
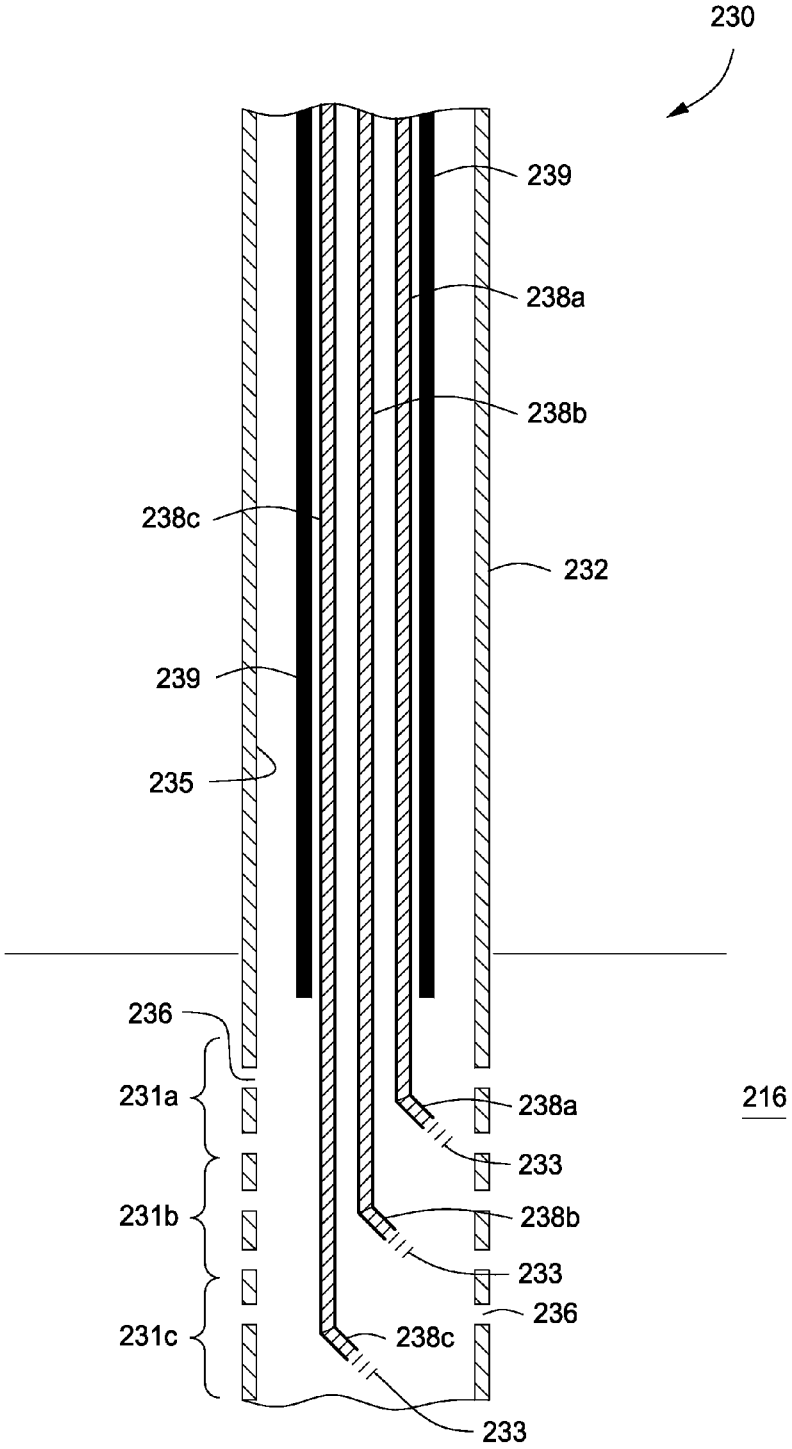
FIG. 2F is an enlarged side view of an insulated cover or sheath, holding three illustrative leads. Each lead, in this embodiment, represents an insulated pipe, rod, cable, or wire. The leads are within a wellbore.

To further demonstrate the relationship between the leads 238 and the terminals 231, FIG. 2F is provided. FIG. 2F is an enlarged side view of the insulated cover or sheath 239, holding three illustrative leads 238*a*, 238*b*, 238*c*. Each lead 238*a*, 238*b*, 238*c* terminates at a different depth, corresponding to a different terminal 231*a*, 231*b*, 231*c* within the organic-rich rock 216. Thus, lead 238*a* terminates at terminal 231*a*; lead 238*b* terminates at terminal 231*b*; and lead 238*c* terminates at terminal 231*c*.

Each electrically conductive lead 238*a*, 238*b*, 238*c* is insulated with a tough rubber or other non-electrically conducting exterior. However, the tips 233 of the conductive leads 238*a*, 238*b*, 238*c* are exposed. This allows the internal metal portions of the leads 238*a*, 238*b*, 238*c* to contact the second proppant 227 (not shown in FIG. 2F).

In order to form an electrical circuit for the heater well arrangement 200, an electricity source is provided at the surface 205. Returning to FIG. 2E, an electricity source is shown at 250. The electricity source 250 may be a local or regional power grid. Alternatively, the electricity source 250 may be a gas-powered turbine or combined cycle power plant located on-site. In any instance, electrical power is generated or otherwise received, and delivered via line 254 to a control system 256. En route, a transformer 252 may optionally be provided to step down (or step up) voltage as needed to accommodate the needs of the terminals 231, 241.

The control system 256 controls the delivery of electrical power to the terminals 231, 241. In this respect, the operator may monitor electrical resistance at the initially selected terminals 231, 241, and change the selected terminals 231, 241 as resistance changes over time. For instance, electrical current may initially be delivered through line 255' to electrical lead 238*a* and down to terminal 231*a* for a designated period of time. As solid hydrocarbons are pyrolyzed (or as heavy hydrocarbons are mobilized), a shift may take place in the host organic-rich rock formation 216, causing a break-up in electrical connectivity with the first proppant 222 near wellbore 230. The shift may take place, for example, as a result of strain on the rock hosting the proppant 222, 227.

It is understood that the process of heating rock in situ, especially rock containing solid hydrocarbons, causes thermal expansion. Thermal expansion is followed by pyrolysis and a loss of solid material supporting the overburden and acting down against the underburden. All of this increases the stress on the fracture 220. This, in turn, may decrease the electrical resistance along any current flow paths in a manner proportional to increased stress on that part of the fracture. In this respect, increased stress on the granular conductor material improves contacts and decreases resistance. On the other hand, a loss of supporting rock matrix could create gaps in proppant 222 or 227, decreasing conductivity. Also, if the stress in the formation drops, resistance will increase even without actual gaps forming. As a result, the operator may choose to switch the delivery of electrical current to, for example, electrical lead 238*c* and, accordingly, through terminal 231*c*.

The control system 256 may simply be a junction box with manually operated switches. In this instance, the operator may take periodic measurements of resistance through the fracture 220 at various terminal locations. Alternatively, the control system 256 may be controlled through software, providing for automated monitoring. Thus, for example, if resistance (or average resistance) at one terminal increases over a designated period of time, the control system 256 may automatically switch to a different terminal. A new average resistance will then be measured and monitored.

A correlation exists between resistance and in situ temperatures. If data from the control system 256 indicates that hydrocarbon fluids are being generated at too high of a temperature, then the current path may be modified to shift energy away from that portion of the fracture 220. Similarly, if resistance measurements suggest that an electrical connection failure has occurred at a first terminal, this will indicate that inadequate heating is taking place. In either instance, the operator may switch the flow of current through a different terminal to obtain heating uniformity. Stated another way, changes in conductivity between different connections after power input is initiated can be used to modulate the power input to different portions of the fracture 220 to optimize performance.

The same process may take place within wellbore 240. Thus, electrical current may initially be received through terminal 241*c* to electrical lead 248*c* and up to line 255" for a designated period of time. As solid hydrocarbons are pyrolyzed (or as heavy hydrocarbons are mobilized), a shift may take place in the second proppant 227, causing a break-up in electrical connectivity with the first proppant 222 near wellbore 240. The operator may then switch the delivery of electrical current from, for example, terminal 241*a* and, accordingly, through electrical lead 248*a* to terminal 241*b* and, accordingly, electrical lead 248*b*.

Preferably, the operator will eventually switch the flow of current through all terminals 231*a-c*, 241*a-c*. By switching the flow of current in this manner, it is believed that a more complete heating of the organic-rich rock formation 216 across the fracture 220 will take place.

Preferably, a portion of the casing strings 232, 242 is fabricated from a non-conductive material. FIG. 2B shows two non-conductive sections 237, 247. The non-conductive sections 237, 247 may be comprised of one or more joints of, for example, ceramic pipe. In the arrangement of FIG. 2B, the non-conductive sections 237, 247 are placed at or near the top of the subsurface formation 210. This ensures that current flows primarily through proppant placed in the formation 216 and not back up the wellbores 230, 240.

It is noted that the heater well arrangement 200 is described in terms of electric current flowing down wellbore 230, and back up wellbore 240. However, the polarities of the circuit may be switched in order to reverse the direction of current flow.

In the illustrative heater well arrangement 200 of FIGS. 2A through 2E, the wellbores 230, 240 are completed in a substantially vertical orientation. However, it is again understood that the wellbores 230, 240 may optionally be completed in a deviated or even substantially horizontal orientation. For purposes of this disclosure, "substantially horizontal" means that an angle of at least 30 degrees off of vertical is created. What is important is that the plane of the fracture 220 intersect the wellbores 230, 240. Thus, before completing the wells, the operator should consider geomechanical forces and formation depth in determining what type of wellbore arrangement to employ. Preferably, a horizontal well is drilled perpendicular to the direction of minimum horizontal stress.

As an alternative to using the two-wellbore arrangement of FIG. 2A, the operator may choose to employ a single well. FIG. 3A is a side, schematic view of a heater well arrangement 300 that uses a single heat injection well. The heat injection well is shown at 330.

The heater well arrangement 300 is for the purpose of heating an organic-rich rock formation 316. This, in turn, facilitates the production of hydrocarbon fluids. Hydrocarbon fluids are produced to the surface through production wells, such as wells "P" shown in FIG. 1, above.

In the arrangement of FIG. 3A, a single wellbore 330 extends from the earth surface 305 and into a subsurface 310. The wellbore 330 is shown as having been completed as a horizontal wellbore. However, it is understood that the wellbore 330 may be completed as a deviated wellbore, or even as a vertical wellbore. In any instance, the wellbore 330 is completed in an organic-rich rock formation 316.

In FIG. 3A, a fracture 320 has been formed from the single wellbore 330. The fracture 320 is formed via hydraulic fracturing. In the heater well arrangement 300, the hydraulic fracturing is used to provide a planar source for heating.

A first electrically conductive proppant has been injected into the fracture 320. The first proppant (not shown) is placed in the fracture 320 by injecting a hydraulic fluid containing the proppant through the perforations along the wellbore 330. The hydraulic fluid is injected into the subsurface formation at a pressure that exceeds a formation parting pressure as is known in the art.

In addition, a second electrically conductive proppant has been injected into the wellbore 330. The second proppant (not shown) has been injected along a number of discrete zones 325 using, for example, a straddle packer (not shown). The second electrically conductive proppant partially displaces or overlaps the first electrically conductive proppant to form a plurality of zones 325.

In accordance with the methods herein, the first electrically conductive proppant (in fracture 320) has a first bulk resistivity. Similarly, the second electrically conductive proppant (in zones 325) has a second bulk resistivity. The second bulk resistivity is lower than the first bulk resistivity, meaning that the second electrically conductive proppant is more electrically conductive than the first electrically conductive proppant. This beneficially serves to prevent regions of excess heating, or "hot spots," that might naturally occur in connection with the flow of electricity into and out of the fracture 320.

Electric current is passed down, and then back up, the wellbore 310 using electrically conductive leads (not shown). Current passes through a first selected zone 325, into the fracture 320, and back to the wellbore through a second selected zone 325. In this manner, the organic-rich rock formation 316 may be heated from the fracture 320 using electrically resistive heating.

Figure 3B:
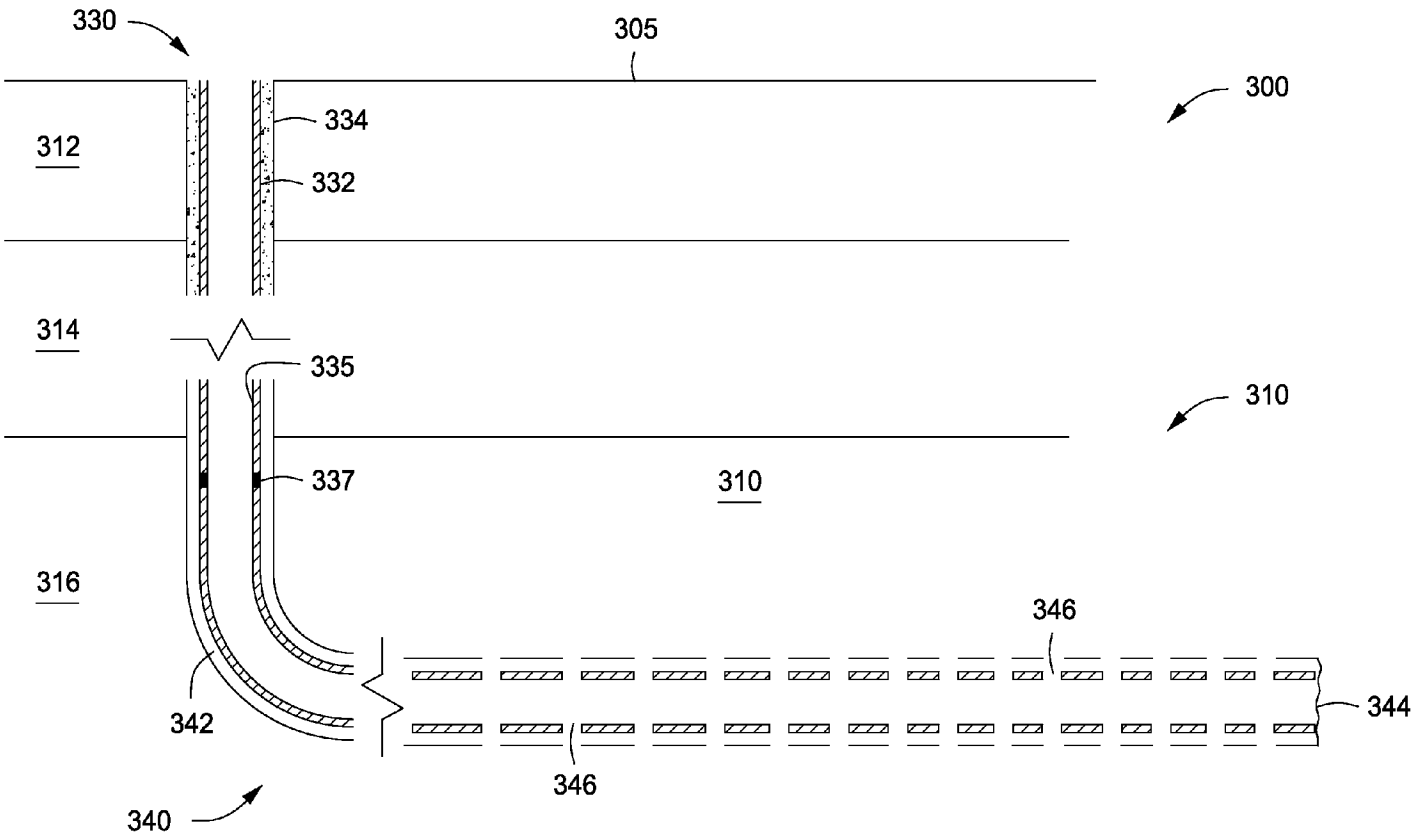
FIGS. 3B through 3E provide side, cross-sectional views of the heater well arrangement of FIG. 3A. In these figures, a single wellbore is shown that penetrates into an interval of organic-rich rock in the subsurface formation. The wellbore has been formed for the purpose of heating the organic-rich rock using resistive heating.

Additional details of the heater well arrangement 300 are shown in the progressive views of FIGS. 3B through 3E. First, FIG. 3B provides a side, cross-sectional view of the heat injection well 330. The well 330 is shown as a wellbore that penetrates through the subsurface formation 310. Specifically, the wellbore 330 has been formed through a near surface formation 312, through one or more intermediate formations 314, and through one or more intervals of organic-rich rock 316 within the subsurface formation 310.

The wellbore 330 has been completed with a string of casing 332. The string of casing 332 defines a bore 335 through which fluids may be injected or equipment may be placed. The casing 332 is secured in place with a cement sheath 334. The cement sheath 334 resides within an annular region formed between the casing 332 and the surrounding near-surface formation 312. The cement sheath 334 isolates any aquifers or sensitive zones along the near-surface formation 312.

The wellbore 330 has been formed to have a deviated portion 340. In the arrangement 300, the deviated portion 340 is substantially horizontal. The deviated portion 340 includes a heel 342 and a toe 344. The wellbore 330 has been perforated along the deviated portion 340. Perforations are shown at 346.

Figure 3C:
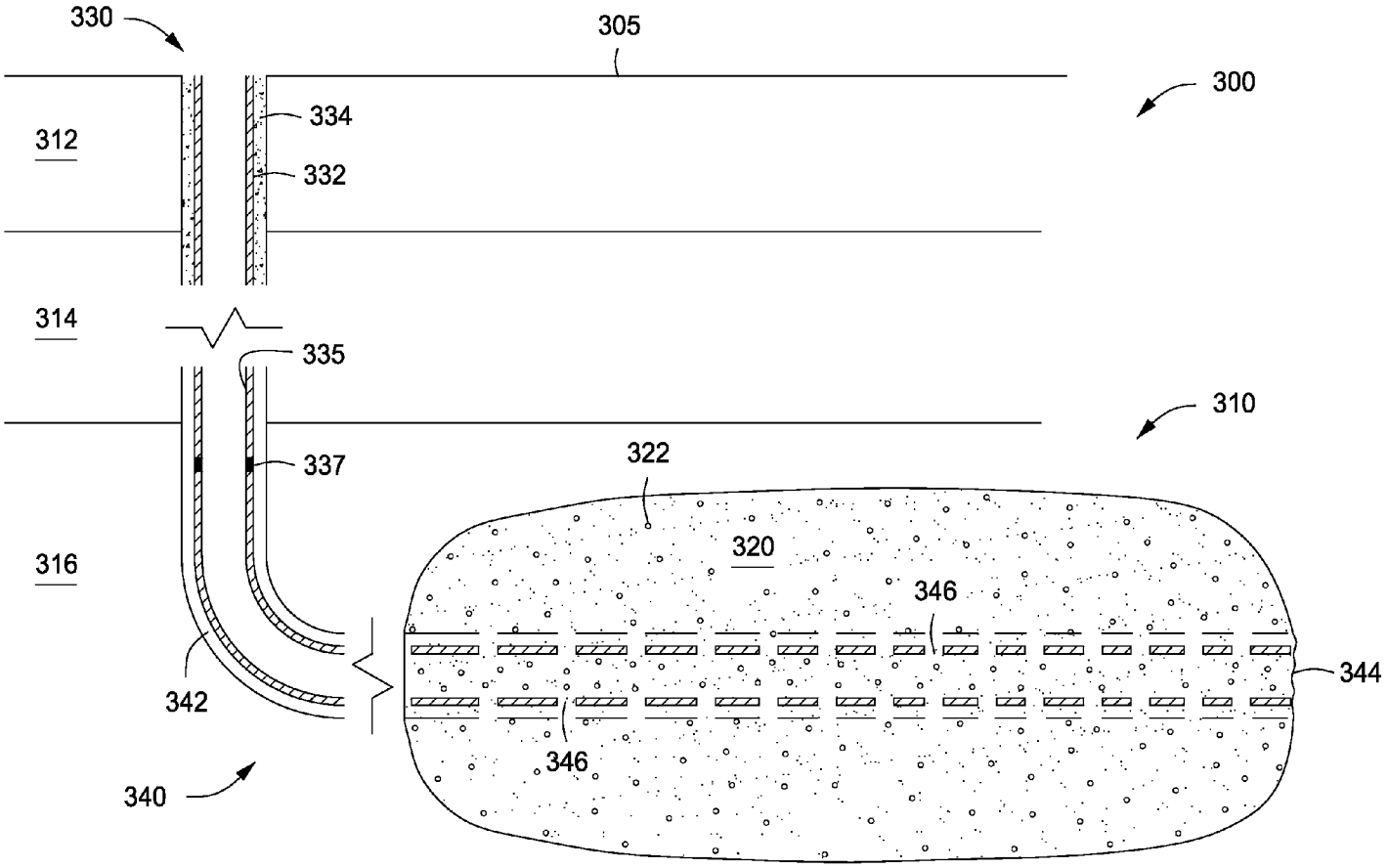

Moving now to FIG. 3C, FIG. 3C provides another cross-sectional view of the wellbore 330 of FIG. 3B. Here, the organic-rich rock 316 is undergoing fracturing. The fracture 320 has been formed in the subsurface formation 310.

In order to form the fracture 320, a hydraulic fluid laden with proppant 322 is injected through the perforations 346. The injection is at a pressure greater than the parting pressure of the subsurface formation 310. The proppant 322 comprises electrically conductive particles such as metal shavings, steel shot, calcined coke, graphite, or combinations thereof. The hydraulic fluid laden with proppant leaves a first electrically conductive proppant 322 within the fracture 320.

Figure 3D:
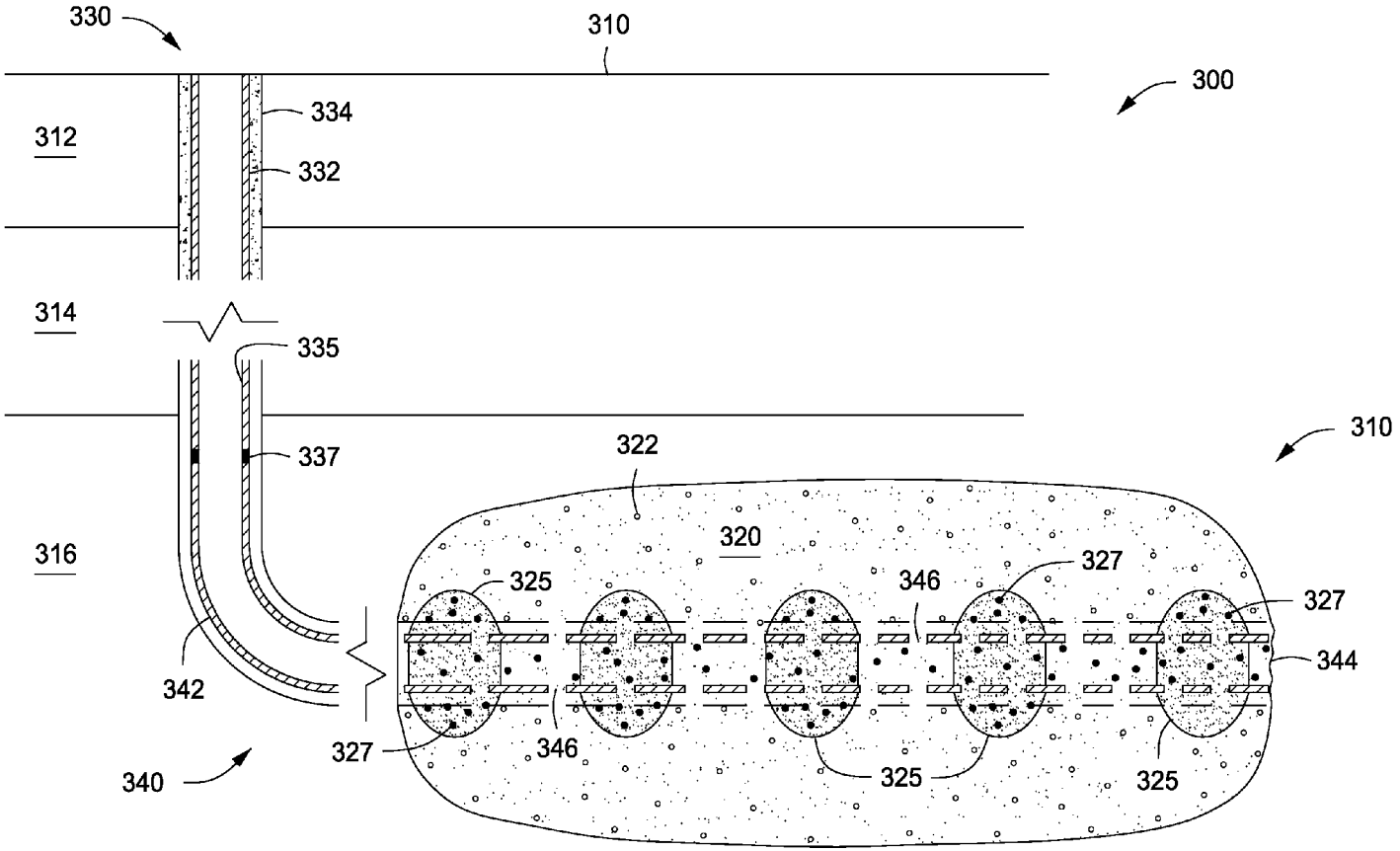

FIG. 3D presents a next step in the forming of the heater well arrangement 300. Here, a second electrically conductive proppant 327 has been injected into the wellbore 330 and at least partially into the fracture 320. In order to place the second proppant 327, a hydraulic fluid laden with proppant is injected through the perforations 346. The injection is at a pressure greater than the parting pressure of the subsurface formation 310. The proppant again comprises electrically conductive particles such as metal shavings, metal coated particles, graphite, steel shot, calcined coke, or combinations thereof. The hydraulic fluid laden with proppant leaves a second electrically conductive proppant 327 within the fracture 320.

It can be seen in FIG. 3D that the second injection of proppant leaves multiple zones of injection 325. The zones 325 define discrete areas of proppant 327 that extend substantially from the heel 342 to the toe 344. Each zone 325 preferably invades the fracture 320 to ensure good contact by the second electrically conductive proppant 327 with the first electrically conductive proppant 322.

It is preferred that a substantially non-conductive material also be placed within the wellbore 330 along the deviated portion 340 and between the distinct terminals. This insures the isolation of the zones of injection 325. The substantially non-conductive material may include, for example, mica, silica, quartz, cement chips, or combinations thereof.

Figure 3E:
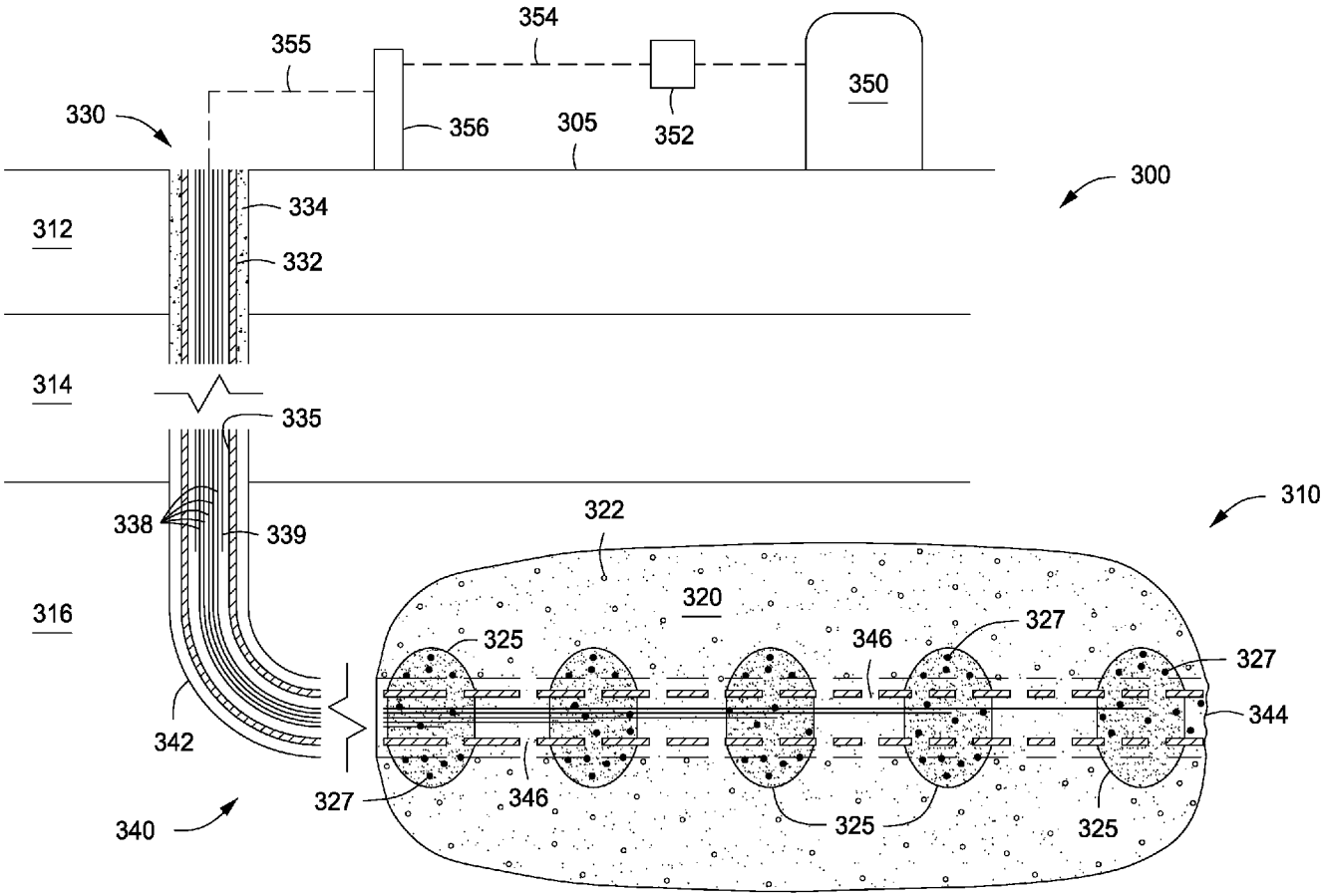

FIG. 3E presents yet another step in the forming of the heater well arrangement 300 and the heating of the subsurface formation 310. Here, electrically conductive leads 338 have been run into the wellbore 330. The leads 338 are preferably bundled into a sheath 339, such as shown in FIG. 2F with leads 238*a*, 238*b*, 238*c* and sheath 239.

Each lead 338 is preferably a copper or other metal wire protected within its own insulated cover. However, the leads 338 may alternatively be steel rods, pipes, bars or cables that are insulated down to the subsurface formation 310. In any embodiment, the leads 338 have a tip that is exposed to the second electrically conductive proppant 327. The tip may be fashioned as tip 233 in FIG. 2F.

In the heater well arrangement 300, each zone 325 represents a discrete terminal. Five illustrative zones 325 are shown, each defining a terminal that receives a respective lead 338. Individual leads 338 extend down to a selected terminal, such as terminals 231*a*, 231*b*, 231*c* of FIG. 2F. In this way, current may be passed into the second electrically conductive proppant 327 through wellbore 330 at one of the selected zones 325, while current may be passed out of the second electrically conductive proppant 327 through another of the selected zones 325, and back up a corresponding electrically conductive lead 338.

In order to form an electrical circuit for the heater well arrangement 300, an electricity source 350 is provided at the surface 305. The electricity source 350 may be a local or regional power grid, or at least electrical lines connected to such a grid. Alternatively, the electricity source 350 may be a gas-powered turbine or combined cycle power plant located on-site. In any instance, electrical power is generated or otherwise received, and delivered via line 354 to a control system 356. En route, a transformer 352 may optionally be provided to step down (or step up) voltage as needed to accommodate the needs of the terminals defined by zones 325.

The control system 356 may simply be a junction box with manually operated switches. Alternatively, the control system 356 may be controlled through software or firmware. As with control system 256 of FIG. 2E, the control system 356 controls the delivery of electrical power to the zones 325, or terminals. In this respect, the operator may monitor electrical resistance at an initially selected terminal, and change the selected terminals as resistivity changes over time.

Preferably, a portion of the casing string 332 is fabricated from a non-conductive material. FIG. 3B shows a non-conductive section 337. The non-conductive section 337 may be comprised of one or more joints of, for example, ceramic pipe. In the arrangement of FIG. 3B, the non-conductive section 337 is placed at or near the top of the subsurface formation 310. This ensures that current flows primarily through proppant placed in the formation 316 and not up the wellbore casing 332.

In operation, electrical current is distributed through the control system 356, through a first electrical lead 338, through the second electrically conductive proppant 327 at a first zone 325, into the fracture 320 in the organic-rich rock formation 316, through the second electrically conductive proppant 327 in a second zone 325, into a second electrical lead 338, and back up to the control system 356 to complete the circuit.

As noted, the first electrically conductive proppant (in fracture 320) has a first bulk resistivity. Similarly, the second electrically conductive proppant (in zones 325) has a second bulk resistivity. The second bulk resistivity is lower than the first bulk resistivity, meaning that the second electrically conductive proppant is more electrically conductive than the first electrically conductive proppant. In this way, heat is generated within the organic-rich rock formation 316 through resistive heat generated by the flow of current primarily through the first electrically conductive proppant 322.

The heater well arrangement 300 allows for piecemeal power control over the length of a fracture.

Other heater well arrangements may be employed for heating a subsurface formation in situ. For example, multiple wellbores (or multiple lateral boreholes from a single wellbore) may be formed through a fracture plane having a first electrically conductive proppant. A second electrically conductive proppant with corresponding electrical leads may then be placed in the multiple wellbores, providing electrical communication with the first electrically conductive proppant and a control system at the surface.

FIG. 4 is a side, schematic view of a heater well arrangement 400 that uses multiple wellbores as heat injection wells. In FIG. 4, two illustrative heat injection wells 430, 440 are shown. The wells 430, 440 intersect a subsurface fracture having electrically conductive proppant therein. Each of the wells 430, 440 employs multiple electrical terminals 425 to allow an operator to select a path of current into or out of a fracture 420.

In the heater well arrangement 400 of FIG. 4, the fracture 420 is created by injecting a proppant-laden slurry through a separately-formed well 450. Various lateral boreholes are then formed to intersect the fracture 420. Thus, lateral boreholes 432, 434, and 436 are formed from well 430. Similarly, lateral boreholes 442, 444, and 446 are formed from well 440. The second electrically conductive proppant is injected at the points of intersection with the fracture 420 to form the multiple terminals 425. Thus, three or more terminals 425 are provided through distinct lateral boreholes.

In operation, current is provided from an electrical source (not shown) at the surface 405. The electrical source may be in accordance with the electrical sources 250 or 350 described above. Electricity is carried down well 430 through a selected electrical lead (not shown), and down through one of the selected lateral boreholes 432, 434, 436. Current is then passed through the second proppant and into the fracture 420 through the first proppant. In this way, electrically resistive heating takes place within an organic-rich rock formation 416.

In order to complete the circuit, the current is passed through the second proppant associated with one of the lateral boreholes 442, 444, 446. Current then travels through an electrically conductive lead in well 440 and back up to the surface 405. The operator controls which zones 425 or terminals receive the current within boreholes 442, 444, 446

It is understood that in order to form the lateral boreholes 432, 434, 436, or 442, 444, 446, whipstocks (not shown) are suitably placed in the respective primary wells 430, 440. The whipstocks will have a concave face for directing a drill string and connected milling bit through a window to be formed in the casing. Preferably, the bottom lateral boreholes 436, 446 are formed first. Preferably, non-conductive casing is used in the deviated portions of the lateral boreholes 432, 434, 436, and 442, 444, 446.

In any of the above-described heater well arrangements 200, 300, 400, the heater wells may be placed in a predesignated pattern. For example, heater wells may be placed in alternating rows with production wells. Alternatively, heater wells may surround one or more production wells. Flow and reservoir simulations may be employed to estimate temperatures and pathways for hydrocarbon fluids generated in situ as they migrate from their points of origin to production wells.

An array of heater wells is preferably arranged such that a distance between each heater well (or operative pairs of heater wells) is less than about 21 meters (70 feet). In alternative embodiments, the array of heater wells may be disposed such that a distance between each heater well (or operative pairs of heater wells) may be less than about 100 feet, or 50 feet, or 30 feet. Regardless of the arrangement or distance between the heater wells, in certain embodiments, a ratio of heater wells to production wells disposed within an organic-rich rock formation may be greater than about 5, 10, or more.

Based upon the illustrative wellbore arrangements 200, 300, 400 described above, methods of heating a subsurface formation using electrical resistance heating are provided herein. Such methods are described in certain embodiments below in connection with FIGS. 5, 6, and 7.

Figure 5:
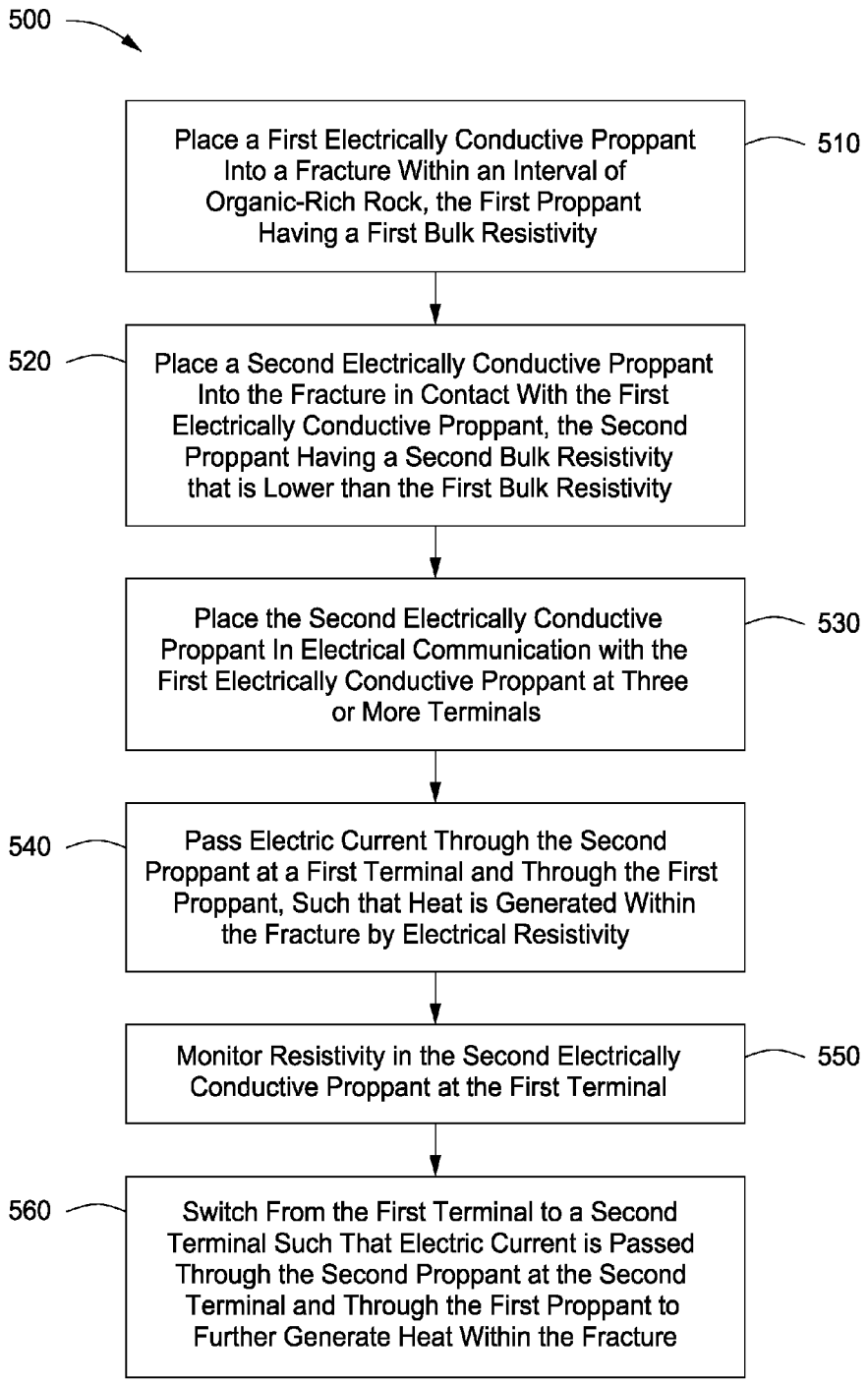
FIG. 5 is a flow chart for a method of heating a subsurface formation using electrical resistance heating, in one embodiment. The flow chart provides steps for the heating. In this instance, the one or more terminals are monitored during heating for electrical resistance.

First, FIG. 5 provides a flowchart for a method 500 for heating a subsurface formation, in one embodiment. The method 500 is broad, and is intended to cover any of the completion arrangements 200, 300, 400 described above.

The method 500 first includes the step of placing a first electrically conductive proppant into a fracture. This is shown in Box 510 of FIG. 5. The fracture has been formed within an interval of organic-rich rock in the subsurface formation. The organic-rich rock may have, for example, a heavy oil such as bitumen. Alternatively, the organic-rich rock may comprise oil shale.

The first electrically conductive proppant is preferably comprised of metal shavings, graphite, steel shot, or calcined coke. The first electrically conductive proppant has a first bulk resistivity. To increase the resistivity, the first electrically conductive proppant may further comprise silica, ceramic, cement, or combinations thereof.

The method 500 also includes placing a second electrically conductive proppant partially into or adjacent the fracture. This is provided at Box 520. The second proppant is placed in contact with the first proppant.

The second electrically conductive proppant also is preferably comprised of metal shavings, steel shot, graphite, or calcined coke. The second proppant has a second bulk resistivity that is lower than the first bulk resistivity.

The method 500 further includes placing the second electrically conductive proppant in electrical communication with the first electrically conductive proppant. This is shown at Box 530. Electrical communication is provided at three or more terminals. In one embodiment, the second proppant is continuous, with the terminals simply being different locations along a wellbore. In another embodiment, the second proppant provides three or more discrete proppant portions along a single wellbore. In still another embodiment, the second proppant provides proppant portions within distinct wellbores or lateral boreholes that intersect the fracture.

The method 500 also comprises passing electric current through the second electrically conductive proppant at a first terminal. This is provided at Box 540. The current passes through the second electrically conductive proppant and through the first electrically conductive proppant. In this way, heat is generated within the at least one fracture by electrical resistivity.

It is understood that the current travels along a circuit, and that the current is received from an electrical source. The electrical source may be electricity obtained from a regional grid. Alternatively, electricity may be generated on-site through a gas turbine or a combined cycle power plant. The circuit will also include an insulated electrical cable, rod, or other device that delivers the current to the selected terminal.

After passing through the first electrically conductive proppant in the fracture, the current travels back to the electrical source at the surface. In returning to the surface, the current may travel back to the first wellbore and return through a separate electrically conductive lead. Alternatively, the current may travel through a separate wellbore to the surface.

The method 500 further includes monitoring resistance in the second electrically conductive proppant. This is seen at Box 550. Resistance is monitored at the first terminal while current passes through that location. In addition, resistance may be measured across multiple individual and combined terminals. This provides a measure of the connection of each terminal to the proppants in the fracture. It also provides an indication of the electrical continuity of the highly conductive second proppant with the less conductive first proppant. Further, such measurements may indicate differences in resistance of current flow in the first electrically conductive proppant. The results of these measurements may be the basis for deciding how to input power to the fracture. The measurements also provide a baseline for comparison with similar measurements taken after the initiation of heating.

The method 500 also includes switching the flow of electricity from the first terminal to a second terminal such that electric current is passed through the second electrically conductive proppant at the second terminal, and through the first electrically conductive proppant to further generate heat within the at least one fracture. This is shown at Box 560. The switching step is preferably based on an analysis of the resistance through the various terminals. The resistances measured across different paths can be combined to evaluate the homogeneity of the conductivity of the granular proppant within the fracture as the heating process progresses.

In one aspect of the method 500, the steps of passing electric current of Boxes 540 and 560 serve to heat the subsurface formation adjacent the at least one fracture to a temperature of at least 300° C. This is sufficient to mobilize heavy hydrocarbons such as bitumen in a tar sands development area. This also is sufficient to pyrolyze solid hydrocarbons into hydrocarbon fluids in a shale oil development area.

Figure 6:
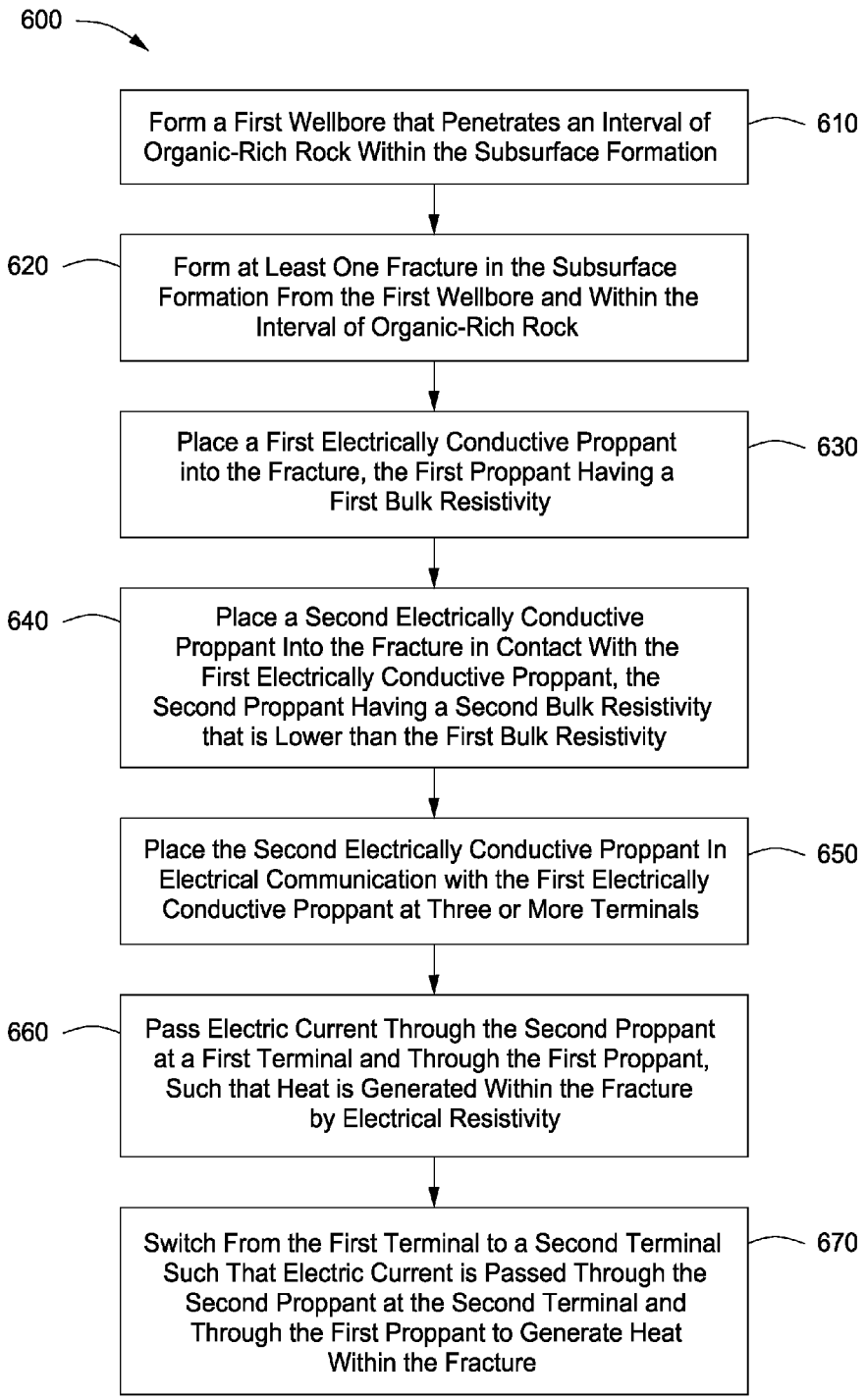
FIG. 6 provides a second flow chart for a method of heating a subsurface formation using electrical resistance heating, in an alternate embodiment. The flow chart shows alternate steps for the heating. In this instance, a wellbore is formed and a fracture is created for the placement of the first electrically conductive proppant.

A separate method of heating a subsurface formation using electrical resistance heating is also provided herein. FIG. 6 provides a flowchart for an alternate method 600 for heating a subsurface formation, in one embodiment. The method 600 also is broad, and is intended to cover any of the completion arrangements 200, 300, 400 described above.

The method 600 first includes the step of forming a first wellbore. This is provided at Box 610. The first wellbore penetrates an interval of organic-rich rock within the subsurface formation.

The method 600 also includes forming at least one fracture in the subsurface formation. This is seen at Box 620. The fracture is formed from the first wellbore and within the interval of organic-rich rock.

The method 600 also comprises placing a first electrically conductive proppant into the at least one fracture. This is indicated in Box 630. The first electrically conductive proppant is preferably comprised of metal shavings, steel shot, graphite, or calcined coke. The first electrically conductive proppant has a first bulk resistivity. To adjust the resistivity, the first electrically conductive proppant may further comprise silica, ceramic, cement, or combinations thereof.

The method 600 also includes placing a second electrically conductive proppant at least partially into the fracture. This is provided at Box 640. The second proppant is placed in contact with the first proppant.

The second electrically conductive proppant also is preferably comprised of metal shavings, steel shot, graphite, or calcined coke. The second proppant is tuned to have a second bulk resistivity that is lower than the first bulk resistivity. This permits electrical current to flow from the wellbore without creating undesirable hot spots. Preferably, the resistivity of the first electrically conductive proppant is about 10 to 100 times greater than the resistivity of the second electrically conductive proppant. In one aspect, the resistivity of the first electrically conductive proppant is about 0.005 to 1.0 Ohm-Meters.

The method 600 further includes placing the second electrically conductive proppant in electrical communication with the first electrically conductive proppant. This is shown at Box 650. Electrical communication is provided at three or more terminals. In one embodiment, the second proppant is continuous, and the terminals are simply different locations along the first wellbore, a second wellbore, or both. In another embodiment, the second proppant provides three or more discrete proppant portions along a single wellbore which is the first wellbore. In still another embodiment, the second proppant provides proppant portions within distinct wellbores or lateral boreholes that intersect the fracture.

The method 600 also comprises passing electric current through the second electrically conductive proppant at a first terminal. This is provided at Box 660. The current passes through the second electrically conductive proppant and through the first electrically conductive proppant. In this way, heat is generated within the at least one fracture by electrical resistivity.

It is again understood that the current travels along a circuit. Thus, an electrical source is provided at the surface. The electrical source is designed to generate or otherwise provide an electrical current to the first electrically conductive proppant located within the fracture. The electrical source may be electricity obtained from a regional grid. Alternatively, electricity may be generated on-site through a gas turbine or a combined cycle power plant.

After passing through the first electrically conductive proppant in the fracture, the current travels back to the electrical source at the surface. In returning to the surface, the current may travel back to the first wellbore and return through a separate electrically conductive lead. Alternatively, the current may travel through a separate wellbore to the surface.

Figure 7:
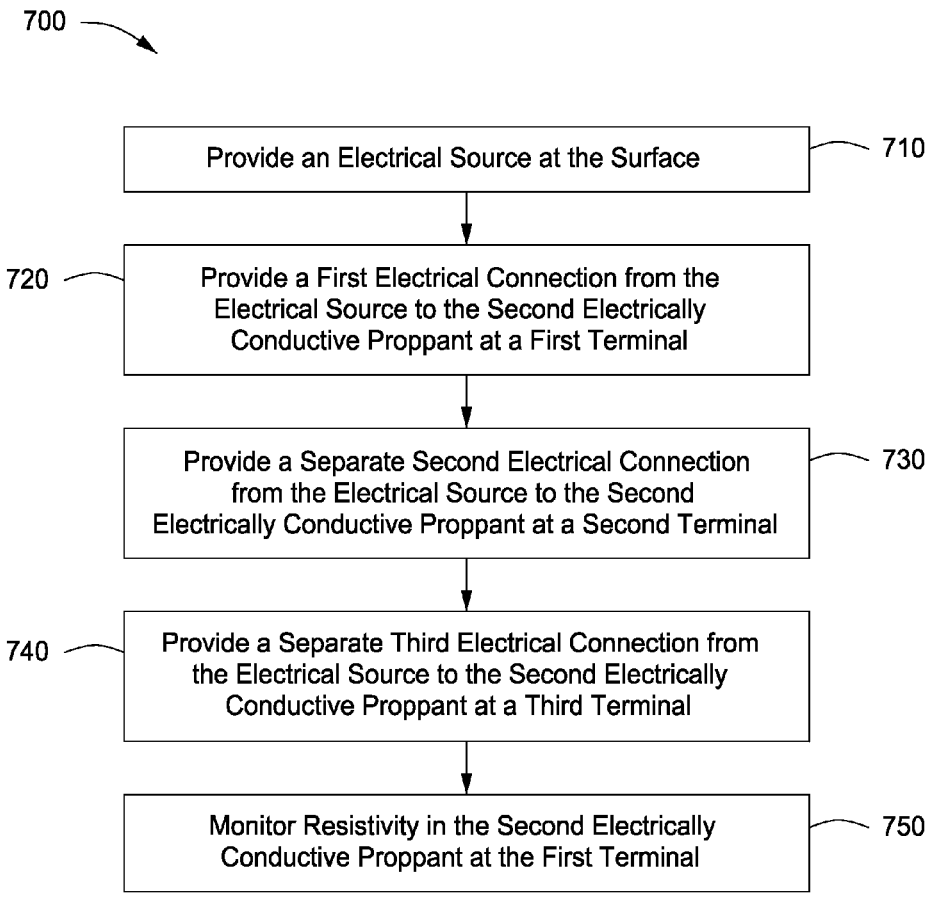
FIG. 7 provides a flow chart for additional steps that may be taken in connection with the heating method of FIG. 6.

FIG. 7 provides a flow chart for steps 700 of passing current through a terminal at the second electrically conductive proppant. The steps 700 include:

providing an electrical source at the surface (Box 710);

providing a first electrical connection from the electrical source to the second electrically conductive proppant at a first terminal (Box 720);

providing a separate second electrical connection from the electrical source to the second electrically conductive proppant at a second terminal (Box 730);

providing a separate third electrical connection from the electrical source to the second electrically conductive proppant at a third terminal (Box 740); and monitoring resistance in the second electrically conductive proppant at the first terminal (Box 750).

The electrical connections in Boxes 720, 730, and 740 are preferably insulated copper wires or cables. However, they may alternatively be insulated rods, bars, or metal tubes. The only requirement is that they transmit electrical current as leads down to the interval to be heated, and that they are insulated from one another.

Referring back to the flow chart of FIG. 6, the method 600 also includes switching the flow of electricity from the first terminal to a second terminal. In this way, electric current is passed through the second electrically conductive proppant at the second terminal, and through the first electrically conductive proppant to generate heat within the at least one fracture. This is seen at Box 670.

In one aspect of the method 600, the steps of Boxes 660 and 670 of passing electric current heat the subsurface formation adjacent the at least one fracture to a temperature of at least 300° C. This is sufficient to mobilize heavy hydrocarbons such as bitumen in a tar sands development area. This also is sufficient to pyrolyze solid hydrocarbons into hydrocarbon fluids in a shale oil development area.

The method 600 may also optionally include producing hydrocarbon fluids from the subsurface formation to the surface. Production takes place through dedicated production wellbores, or "producers," separate from the wellbore or wellbores formed for heating.

As can be seen, various methods and systems are provided herein for heating an organic-rich rock within a subsurface formation. The methods and systems may be employed with a plurality of heater wells in a hydrocarbon development area, each of which operates with a planar heat source in such a manner that electrically conductive proppant is placed within a fracture from a wellbore. The methods and systems build on the previous "ElectroFrac™" procedures by employing multiple terminals with highly conductive proppant connections. The use of a highly conductive proppant at multiple locations mitigates the problem of point source heating associated with the transition for electrical source to the resistive proppant, and also allows the operator to measure resistance and change the flow of current through the proppant. Multiple connections also provide redundancy in the event that one of the connections fails due to strain of the rock hosting the proppant.

What is claimed is:

1. A method of heating a subsurface formation using electrical resistance heating, comprising:

placing a first electrically conductive proppant into a fracture within an interval of organic-rich rock, the first electrically conductive proppant having a first bulk resistivity;

placing a second electrically conductive proppant at least partially into the fracture, the second electrically conductive proppant having a second bulk resistivity that is lower than the first bulk resistivity, and the second electrically conductive proppant being in contact with the first electrically conductive proppant at three or more terminals;

passing electric current through the second electrically conductive proppant at a first terminal and through the first electrically conductive proppant, such that heat is generated within the at least one fracture by electrical resistivity;

monitoring resistance in the second electrically conductive proppant at the first terminal; and switching from the first terminal to a second terminal such that electric current is passed through the second electrically conductive proppant at the second terminal, and through the first electrically conductive proppant to further generate heat within the at least one fracture.

2. The method of claim 1, wherein the steps of passing electric current heat the subsurface formation adjacent the at least one fracture to a temperature of at least 300° C.

3. The method of claim 1, further comprising:

monitoring resistance at each of the terminals; and determining an average resistance over a designated period of time at each of the terminals to evaluate the uniformity of heating in the fracture.

4. A method of heating a subsurface formation using electrical resistance heating, comprising:

forming a first wellbore that penetrates an interval of organic-rich rock within the subsurface formation;

forming at least one fracture in the subsurface formation from the first wellbore and within the interval of organic-rich rock;

placing a first electrically conductive proppant into the at least one fracture, the first electrically conductive proppant having a first bulk resistivity;

placing a second electrically conductive proppant in or adjacent to the at least one fracture, the second electrically conductive proppant being in contact with the first electrically conductive proppant at three or more terminals, and wherein the second electrically conductive proppant has a second bulk resistivity that is lower than the first bulk resistivity;

passing electric current through the second electrically conductive proppant at a first terminal and through the first electrically conductive proppant, such that heat is generated within the at least one fracture by electrical resistivity; and switching from the first terminal to a second terminal such that electric current is passed through the second electrically conductive proppant at the selected terminal, and through the first electrically conductive proppant to further generate heat within the at least one fracture.

5. The method of claim 4, wherein:

the subsurface formation comprises bitumen; and the steps of passing electric current heat the subsurface formation to at least partially mobilize the bitumen within the formation.

6. The method of claim 4, wherein:

the subsurface formation comprises oil shale; and the steps of passing electric current heat the subsurface formation to pyrolyze at least a portion of the oil shale into hydrocarbon fluids.

7. The method of claim 4, further comprising:

providing an electrical source at the surface;

providing a first electrical connection from the electrical source to the second electrically conductive proppant at a first terminal;

providing a separate second electrical connection from the electrical source to the second electrically conductive proppant at a second terminal;

providing a separate third electrical connection from the electrical source to the second electrically conductive proppant at a third terminal; and monitoring resistance in the second electrically conductive proppant at the first terminal.

8. The method of claim 4, further comprising:

monitoring resistance at a plurality of the terminals; and determining an average resistance over a designated period of time at each of the terminals to evaluate the uniformity of heating in the fracture.

9. The method of claim 7, wherein:

placing a first electrically conductive proppant into the at least one fracture is done by injecting a slurry containing the first electrically conductive proppant from at least the first wellbore;

placing the second electrically conductive proppant in or adjacent to the at least one fracture is done by injecting a slurry containing the second electrically conductive proppant from the first wellbore; and the second electrically conductive proppant is in electrical communication with the first electrically conductive proppant at the first, second and third terminals along the first wellbore.

10. The method of claim 9, wherein:

the first wellbore is completed in the interval of organic-rich rock in a substantially vertical orientation; and the fracture is formed in a substantially vertical orientation.

11. The method of claim 9, wherein:

the first wellbore is completed in the interval of organic-rich rock in a substantially horizontal orientation;

the second electrically conductive proppant is placed in discrete locations along the first wellbore to form the three or more distinct terminals; and the fracture is formed in a substantially vertical orientation or in a substantially horizontal orientation.

12. The method of claim 9, further comprising:

forming a second wellbore that also penetrates the interval of organic-rich rock within the subsurface formation;

forming at least one fracture in the organic-rich rock from the second wellbore and within the interval of organic-rich rock; and linking the at least one fracture from the second wellbore with the at least one fracture from the first wellbore so that fluid communication is established between the first wellbore and the second wellbore.

13. The method of claim 12, wherein:

the first wellbore and the second wellbore is each completed in the interval of organic-rich rock in a substantially vertical orientation;

placing a first electrically conductive proppant into the at least one fracture is further done by injecting the slurry containing the first electrically conductive proppant from the second wellbore; and the fracture is formed between the first wellbore and the second wellbore in a substantially vertical orientation.

14. The method of claim 7, wherein the second electrically conductive proppant is continuous along the first wellbore.

15. The method of claim 7, wherein:

the first wellbore is completed in the interval of organic-rich rock in a substantially horizontal orientation; and the three or more terminals are discrete.

16. The method of claim 7, wherein:

placing a first electrically conductive proppant into the at least one fracture is done by injecting a slurry containing the first electrically conductive proppant from the first wellbore; and placing a second electrically conductive proppant in or adjacent to the at least one fracture comprises:

forming two or more second wellbores in addition to the first wellbore, with each of the two or more wellbores intersecting the first electrically conductive proppant in at least one of the one or more fractures; and injecting the slurry containing the second electrically conductive proppant from each of the one or more second wellbores such that the three or more terminals represent multiple discrete areas of second electrically conductive proppant.

17. The method of claim 7, wherein:

placing the second electrically conductive proppant in or adjacent to the at least one fracture is done by injecting a slurry containing the second electrically conductive proppant from two or more wellbores that are distinct from the first wellbore; and each of the three or more terminals is located in a distinct wellbore.

18. The method of claim 4, wherein the heat generated within the fracture from the first electrically conductive proppant is at least 25° C. greater than heat generated within the second electrically conductive proppant.

19. The method of claim 4, wherein the first electrically conductive proppant and the second electrically conductive proppant each comprises metal shot or shavings, metal coated particles, coke, graphite, or combinations thereof.

20. The method of claim 19, wherein the first electrically conductive proppant further comprises silica, ceramic, cement, or combinations thereof.

21. The method of claim 19, wherein the resistivity of the first electrically conductive proppant is about 10 to 100 times greater than the resistivity of the second electrically conductive proppant.

22. The method of claim 4, further comprising:

producing hydrocarbon fluids from the subsurface formation to a surface.

23. A method of heating a subsurface formation using electrical resistance heating, comprising:

forming a first wellbore that penetrates an interval of organic-rich rock within the subsurface formation;

forming a second wellbore that also penetrates the interval of organic-rich rock within the subsurface formation;

forming at least one fracture in the surface formation from the first wellbore and the second wellbore within the interval of organic-rich rock;

placing a first electrically conductive proppant into the at least one fracture, the first electrically conductive proppant having a first bulk resistivity;

placing a second electrically conductive proppant along the first wellbore at least partially into the at least one fracture, wherein the second electrically conductive proppant has a second bulk resistivity that is lower than the first bulk resistivity;

providing electrical connections from an electrical source at the surface to the second electrically conductive proppant at three or more terminals;

passing electric current through the second electrically conductive proppant at a first terminal, through the first electrically conductive proppant, and to the second wellbore, such that heat is generated within the at least one fracture by electrical resistivity; and switching from the first terminal to a second terminal such that electric current is passed through the second electrically conductive proppant at the selected terminal, and through the first electrically conductive proppant to generate heat within the at least one fracture.

24. The method of claim 23, wherein:

the subsurface formation comprises bitumen; and the steps of passing electric current heat the subsurface formation to at least partially mobilize the bitumen within the formation.

25. The method of claim 23, wherein:

the subsurface formation comprises oil shale; and the steps of passing electric current heat the subsurface formation to pyrolyze at least a portion of the oil shale into hydrocarbon fluids.

26. The method of claim 25, wherein the steps of passing electric current heat the subsurface formation adjacent the at least one fracture to a temperature of at least 300° C.

27. The method of claim 23, wherein:

placing a first electrically conductive proppant into the at least one fracture is done by injecting a slurry containing the first electrically conductive proppant from each of the first wellbore and the second wellbore such that at least one of the at least one fractures is linked;

placing the second electrically conductive proppant into the at least one fracture is done by injecting a slurry containing the second electrically conductive proppant from the first wellbore;

the second electrically conductive proppant is continuous along the first wellbore; and the second electrically conductive proppant is in contact with the first electrically conductive proppant at the three or more terminal portions along the first wellbore.

28. The method of claim 27, wherein:

the first wellbore and the second wellbore is each completed in the interval of organic-rich rock in a substantially vertical orientation;

the fracture is formed between the first wellbore and the second wellbore in a substantially vertical orientation.

29. The method of claim 23, further comprising:

further placing the second electrically conductive proppant in or adjacent to the at least one fracture from the second wellbore.

30. The method of claim 29, wherein the second electrically conductive proppant is in contact with the first electrically conductive proppant at three or more terminal portions along the second wellbore.

31. The method of claim 23, further comprising:

monitoring resistance at each of the terminals along the first wellbore; and determining an average resistance over a designated period of time at each of the terminals along the first wellbore to evaluate the uniformity of heating in the fracture.

32. A method of heating a subsurface formation using electrical resistance heating, comprising:

forming a wellbore that penetrates an interval of organic-rich rock within the subsurface formation;

forming at least one fracture in the surface formation from the wellbore within the interval of organic-rich rock;

placing a first electrically conductive proppant into the at least one fracture, the first electrically conductive proppant having a first bulk resistivity;

placing a second electrically conductive proppant at least partially into the at least one fracture at distinct locations along the wellbore, wherein the second electrically conductive proppant has a second bulk resistivity that is lower than the first bulk resistivity;

providing electrical connections from an electrical source at the surface to the second electrically conductive proppant at the distinct locations to form three or more distinct terminals along the wellbore;

passing electric current through the second electrically conductive proppant at a first terminal, through the first electrically conductive proppant, and to the second electrically conductive proppant at a second terminal, such that heat is generated within the at least one fracture by electrical resistivity; and either (i) switching from the first terminal to a third terminal such that electric current is passed through the second electrically conductive proppant at the third terminal, through the first electrically conductive proppant and through the first electrically conductive proppant at the second terminal to further generate heat within the at least one fracture, or (ii) switching from the second terminal to a third terminal such that electric current is passed through the second electrically conductive proppant at the first terminal, through the first electrically conductive proppant and through the first electrically conductive proppant at the third terminal to further generate heat within the at least one fracture.

33. The method of claim 32, wherein:

the subsurface formation comprises bitumen; and the steps of passing electric current heat the subsurface formation to at least partially mobilize the bitumen within the formation.

34. The method of claim 32, wherein:

the subsurface formation comprises oil shale; and the steps of passing electric current heat the subsurface formation to pyrolyze at least a portion of the oil shale into hydrocarbon fluids.

35. The method of claim 34, wherein the steps of passing electric current heat the subsurface formation adjacent the at least one fracture to a temperature of at least 300° C.

36. The method of claim 32, further comprising:

providing an electrical source at the surface;

providing a first electrical connection from the electrical source to the second electrically conductive proppant at the first terminal;

providing a separate second electrical connection from the electrical source to the second electrically conductive proppant at the second terminal; and providing a separate third electrical connection from the electrical source to the second electrically conductive proppant at a third terminal.

37. The method of claim 36, further comprising:

monitoring resistance at each of the terminals; and determining an average resistance over a designated period of time at each of the terminals to evaluate the uniformity of heating in the fracture.

38. The method of claim 36, wherein:

the first wellbore is completed in the interval of organic-rich rock in a substantially horizontal orientation;

placing a first electrically conductive proppant into the at least one fracture is done by injecting a slurry containing the first electrically conductive proppant from the wellbore;

placing the second electrically conductive proppant in or adjacent to the at least one fracture is done by injecting a slurry containing the second electrically conductive proppant from the wellbore; and the second electrically conductive proppant is in contact with the first electrically conductive proppant at three or more distinct terminal portions along a substantially horizontal portion of the wellbore.

39. The system of claim 38, further comprising:

placing a substantially non-conductive material within the wellbore between the distinct terminals.

40. The system of claim 39, wherein the substantially non-conductive material comprises mica, silica, quartz, cement chips, or combinations thereof.

41. A method of heating a subsurface formation using electrical resistance heating, comprising:

forming a first wellbore that penetrates an interval of organic-rich rock within the subsurface formation;

forming at least one fracture in the surface formation from the first wellbore and within the interval of organic-rich rock;

placing a first electrically conductive proppant into the at least one fracture, the first electrically conductive proppant having a first bulk resistivity;

forming a plurality of second wellbores;

placing a second electrically conductive proppant at least partially into the at least one fracture from each of the second wellbores, thereby forming a plurality of terminals, the second electrically conductive proppant being in electrical communication with the first electrically conductive proppant, and wherein the second electrically conductive proppant has a second bulk resistivity that is lower than the first bulk resistivity;

passing electric current through the second electrically conductive proppant at a first terminal, and through the first electrically conductive proppant, such that heat is generated within the at least one fracture by electrical resistivity; and switching from the first terminal to a second terminal such that electric current is passed through the second electrically conductive proppant at the selected terminal, and through the first electrically conductive proppant to generate heat within the at least one fracture.

42. The method of claim 41, wherein:

the subsurface formation comprises bitumen; and the steps of passing electric current heat the subsurface formation to at least partially mobilize the bitumen within the formation.

43. The method of claim 41, wherein:

the subsurface formation comprises oil shale; and the steps of passing electric current heat the subsurface formation to pyrolyze at least a portion of the oil shale into hydrocarbon fluids.

44. The method of claim 43, wherein the steps of passing electric current heat the subsurface formation adjacent the at least one fracture to a temperature of at least 300° C.

45. The method of claim 41, further comprising:

providing an electrical source at the surface;

providing a first electrical connection from the electrical source to the second electrically conductive proppant at the first terminal;

providing a separate second electrical connection from the electrical source to the second electrically conductive proppant at the second terminal; and providing a separate third electrical connection from the electrical source to the second electrically conductive proppant at the third terminal; and wherein each of the plurality of terminals is located in a distinct wellbore.

46. The method of claim 45, wherein:

placing a first electrically conductive proppant into the at least one fracture is done by injecting a slurry containing the first electrically conductive proppant from the first wellbore.

47. The method of claim 45, wherein each of the plurality of second wellbores comprises a deviated portion.

48. The method of claim 47, wherein:

the deviated portion in at least some of the wellbores is a lateral borehole shared from a parent wellbore; and each horizontal portion has a heel adjacent the primary portion, and a toe distal from the primary portion.

49. The method of claim 45, further comprising:

monitoring resistance at each of the terminals; and determining an average resistance over a designated period of time at each of the terminals to evaluate the uniformity of heating in the fracture.

50. A system for electrically heating an organic-rich rock formation below an earth surface, the system comprising:

an electricity source at the earth surface;

a first wellbore having a heat injection portion that penetrates an interval of solid organic-rich rock within the subsurface formation;

a fracture in the surface formation along a plane that is generally parallel with the heat injection portion of the wellbore;

a first electrically conductive proppant within the fracture, the first electrically conductive proppant having a first bulk resistivity;

a second electrically conductive proppant placed along one or more wellbores, the second electrically conductive proppant having a second bulk resistivity that is lower than the first bulk resistivity and being in electrical communication with the first electrically conductive proppant;

a first electrical lead in a wellbore providing electrical communication between the electricity source at the surface and the second electrically conductive proppant at a first terminal;

a second electrical lead in a wellbore providing electrical communication between the electricity source and the second electrically conductive proppant at a second terminal;

a third electrical lead in a wellbore providing electrical communication between the electricity source and the second electrically conductive proppant at a second terminal; and a control system configured to allow an operator to monitor resistance within the three terminals while passing current from the electricity source, and to redirect current from the electricity source among the three terminals.

* * * * *